US009120649B2

(12) United States Patent
Ng et al.

(10) Patent No.: US 9,120,649 B2
(45) Date of Patent: Sep. 1, 2015

(54) SYSTEM AND METHOD FOR THE COUPLING OF A HEAD FRAME

(75) Inventors: Ghee Hua Ng, Singapore (SG); ZhanMin Tong, Singapore (SG)

(73) Assignee: NSL ENGINEERING PTE LTD., Singapore (SG)

( * ) Notice: Subject to any disclaimer, the term of this patent is extended or adjusted under 35 U.S.C. 154(b) by 289 days.

(21) Appl. No.: 13/518,994

(22) PCT Filed: Dec. 13, 2010

(86) PCT No.: PCT/SG2010/000463

§ 371 (c)(1),
(2), (4) Date: Jun. 25, 2012

(87) PCT Pub. No.: WO2011/078792

PCT Pub. Date: Jun. 30, 2011

(65) Prior Publication Data

US 2012/0267452 A1 Oct. 25, 2012

(51) Int. Cl.

| | |
|---|---|
| ***B66C 1/00*** | (2006.01) |
| ***B66C 1/66*** | (2006.01) |
| ***B66C 1/10*** | (2006.01) |
| ***B66C 13/14*** | (2006.01) |

(52) U.S. Cl.

CPC ..... *B66C 1/663* (2013.01); *B66C 1/104* (2013.01); *B66C 13/14* (2013.01); *Y10T 29/49826* (2015.01); *Y10T 29/53* (2015.01)

(58) Field of Classification Search

CPC ..... B66C 1/663; B66C 1/104
USPC ..... 294/81.1, 81.53, 81.2; 212/326, 316; 254/396, 398, 393, 394, 395, 397
See application file for complete search history.

(56) References Cited

U.S. PATENT DOCUMENTS 3,552,794 A 1/1971 Wright
3,561,617 A * 2/1971 Marsh ..... 414/140.1

(Continued)

FOREIGN PATENT DOCUMENTS

CN 101111447 A 1/2008
DE 9405112 U1 5/1994

(Continued)

OTHER PUBLICATIONS

PCT/IPEA/416 Notification of Transmittal of International Preliminary Report on Patentability, with PCT/IPEA/409 International Preliminary Report on Patentability, for corresponding PCT International Application No. PCT/SG2010/000463, completed on May 1, 2012 and mailed on May 3, 2012.

(Continued)

*Primary Examiner* — Saul Rodriguez
*Assistant Examiner* — Gabriela Puig
(74) *Attorney, Agent, or Firm* — Heslin Rothenberg Farley & Mesiti P.C.; Victor A. Cardona, Esq.

(57) ABSTRACT

A system for mounting a head frame to a spreader includes a sheave assembly connecting the head frame to a crane so as to permit the lowering of the head frame, mutually cooperating engagement devices for coupling the head frame and the spreader, an actuator arranged to connect mutually engageable transmission connectors on the head frame and spreader, and a registration device for registering the coupling of the head frame and the spreader. The registration device is arranged to prevent engagement of the transmission connector until the head frame and spreader are coupled.

14 Claims, 27 Drawing Sheets

(56) References Cited

U.S. PATENT DOCUMENTS

| | | | | |
|---|---|---|---|---|
| 4,350,254 | A | 9/1982 | Noly | |
| 6,138,846 | A * | 10/2000 | Baumann | 212/326 |
| 7,690,707 | B2 * | 4/2010 | Stinis et al. | 294/81.2 |
| 8,226,136 | B2 * | 7/2012 | Mills et al. | 294/81.1 |
| 8,251,417 | B2 * | 8/2012 | Mills | 294/81.1 |
| 8,469,420 | B2 * | 6/2013 | Mills et al. | 294/81.1 |
| 2004/0189031 | A1 | 9/2004 | Zhu | |
| 2005/0225104 | A1 * | 10/2005 | Lim et al. | 294/81.1 |
| 2007/0296228 | A1 * | 12/2007 | Mills et al. | 294/81.1 |
| 2010/0109359 | A1 * | 5/2010 | Mills et al. | 294/81.2 |
| 2010/0117388 | A1 * | 5/2010 | Mills et al. | 294/81.6 |

FOREIGN PATENT DOCUMENTS

| | | | |
|---|---|---|---|
| DE | 19522819 | A1 | 1/1997 |
| FR | 2669152 | A1 | 5/1992 |
| KR | 100251593 | B | 4/2000 |
| KR | 2004033864 | A | 4/2004 |
| WO | WO2006/083230 | A1 | 8/2006 |

OTHER PUBLICATIONS

PCT/ISA/220 Notification of Transmittal of the International Search Report and the Written Opinion of the International Searching Authority with PCT/ISA/210 International Search Report and PCT/ISA/237 Written Opinion of the International Searching Authority, for corresponding PCT International Application No. PCT/SG2010/000463, completed on Mar. 18, 2011 and mailed on Apr. 6, 2011.

Supplementary European Search Report issued on Nov. 14, 2013 for corresponding European Patent Application No. 10839907, completed Nov. 7, 2013.

Office Action issued on Mar. 10, 2014 for corresponding Chinese Application—Chinese Application No. 201080059271.4.

* cited by examiner

SYSTEM AND METHOD FOR THE COUPLING OF A HEAD FRAME

CROSS REFERENCE TO RELATED APPLICATIONS

This application is a national stage of PCT International Application No. PCT/SG2010/000463, filed on Dec. 13, 2010, and published in English on Jun. 30, 2011, as WO 2011/078792 A1, which claims priority from Singapore patent application No. SG 200908619-0, filed on Dec. 23, 2009, the entire disclosures of which are incorporated herein by reference.

FIELD OF INVENTION

The invention relates to spreaders and head frames, or head blocks, used for the transportation of shipping containers. In particular, the invention relates to systems and methods for coupling a head frame and spreader prior to engaging a container.

BACKGROUND

Head blocks or head frames are mechanical devices having sheaves on an upper side and engagement devices, such as twist locks or connecting pins, on a lower side. The engagement devices are intended to come into contact with a spreader so as to couple the head frame and spreader. This is typically used for swapping spreaders for maintenance purposes. Other purposes include switching between a twin spreader arrangement to a single spreader arrangement such as for a system disclosed in WO2006/083230, WO2008/136766 and WO2008/136767, the contents of which are incorporated herein by reference. The pin or twist lock connections allow a spreader to be attached to the head frame or removed from it for maintenance or other purposes.

Unlike the twist lock arrangements used for a spreader to engage a container, the twist lock and pin connection of a head frame are normally engaged manually. This manual engagement, as compared to a powered arrangement, is a reflection of the frequency with which a spreader is removed from a head frame. Whilst a spreader will engage many containers in a single day, maintenance may occur only once every several months. Consequently, there is no pressing need to include a powered system in order to engage and disengage the twist locks or other engagement devices coupling a head frame to a spreader.

In any event, even if the engagement device was automated at some point, it would be necessary for a manual operation as the electrical connection between the head frame and the spreader also needs to be disconnected and reconnected on engagement which again must be manually perform.

SUMMARY OF INVENTION

In general terms, the present invention provides for an automated system and method for the coupling and connection of a head frame to a spreader.

In a first aspect, the invention provides a system for mounting a head frame to a spreader comprising: a sheave assembly connecting the head frame to a crane so as to permit the lowering of said head frame; mutually cooperating engagement devices for coupling the head frame and the spreader; an actuator arranged to connect mutually engageable transmission connectors on the head frame and spreader; and; a registration device for registering the coupling of the head frame and the spreader; wherein the registration device is arranged to prevent engagement of the transmission connector until said head frame and spreader are coupled.

In a second aspect, the invention provides a method for mounting a head frame to a spreader comprising the steps of: lowering the head frame into contact with the spreader; operating engagement devices and so coupling the head frame to the spreader; activating an actuator to connect mutually engageable power supply connectors on the head frame and spreader so as to provide a power communication between said head frame and spreader.

In a third aspect, accordingly, the invention provides for registering the coupling of the head frame and spreader so as to permit the connection of a power supply data transmission or telecommunication.

In a fourth aspect, the invention provides a spreader assembly comprising a head frame comprising a main frame and a sub frame; a spreader mounted to said sub frame; said main frame and sub frame having mutually engageable connecting members in sliding engagement; wherein said mutually engageable connecting members provide relative longitudinal movement between said head frame and spreader.

Whilst maintenance may be infrequent, the growing use of twin spreaders for a single head frame is a significant segment of the industry and therefore the need to switch between single spreaders and twin spreaders is a pressing need. Providing an automated or semi-automated process to this increasingly more common procedure has economic advantage through reduced downtime on the capital equipment.

The connectors may provide electrical, hydraulic, data or telecommunication transmission. In operation, they may include a plug, actuated by a cylinder to project linearly to engage a socket. The plug and bell mouth socket may be properly engaged and guided before the 2 halves of the multi-pin connectors in the two parts start to engage. There may be sufficient clearance for the socket to move laterally (up-and-down and left-and-right) and aligned with the plug when engaged. The close tolerance between the inner diameter of the socket sleeve and plug may ensure good angular tolerance and the key and keyway on the plug and socket respectively ensure the rotational alignment of the connectors.

Other design features may include:

1. A rain-cover above the connectors to prevent the ingress of rain water.
2. The twist lock and auto-connector may be electrically actuated instead of hydraulic actuator so that a hydraulic power pack is not required on the head frame.

BRIEF DESCRIPTION OF DRAWINGS

It will be convenient to further describe the present invention with respect to the accompanying drawings that illustrate possible arrangements of the invention. Other arrangements of the invention are possible and consequently the particularity of the accompanying drawings is not to be understood as superceding the generality of the preceding description of the invention.

DETAILED DESCRIPTION

Figure 1:
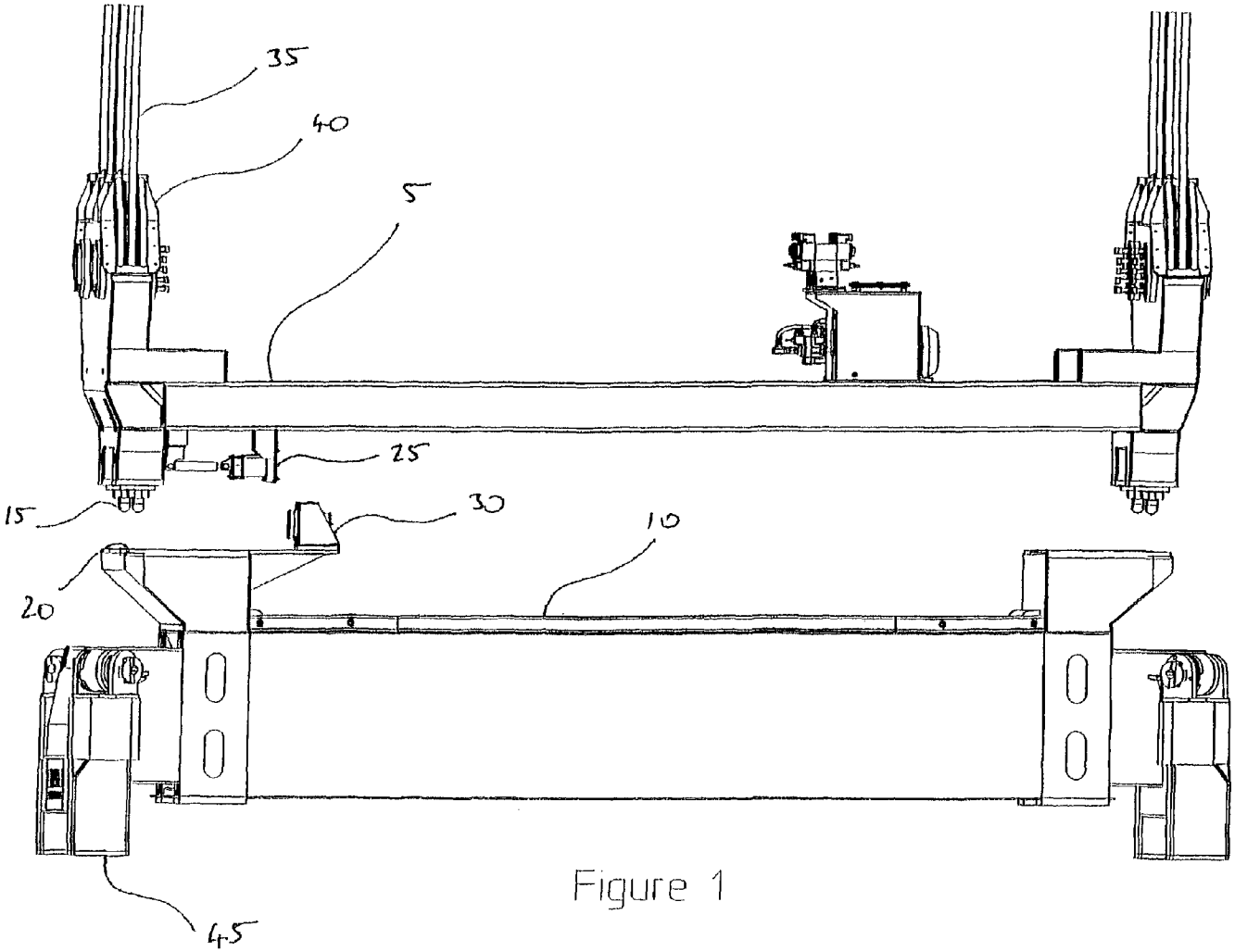
FIGS. 1 to 6 are sequential elevation views of a single spreader application according to one embodiment of the present invention.

FIGS. 1 to 6 show an application where a single spreader corresponds to a single head frame with the transmission connector, or connector assembly, corresponding to the single design. An alternative design, as shown in FIGS. 7 to 12, corresponds to an application using two spreaders and two head frames where under some circumstances it may be preferable to switch between a single and twin spreader arrangement. A still further design, as shown in FIGS. 13 to 17, involves a single head frame with movable sheaves in order to engage either a single spreader or two spreaders.

Considering the single spreader arrangement shown in FIGS. 1 to 6, we see a head frame 5 attached to a crane (not shown) through cables 35 and sheaves 40 so as to raise and lower the head frame 5 and subsequently raise and lower the spreader, after coupling.

The spreader 10 may be resting on the ground or on a frame ready for coupling with the head frame 5. Characteristic of the head frame 5 are engagement devices 15, in this case twist locks 15, which are engageable with apertures 20 in the spreader 10. The spreader 10 further has engagement devices 45 for subsequent engagement of a shipping container.

Figure 18:
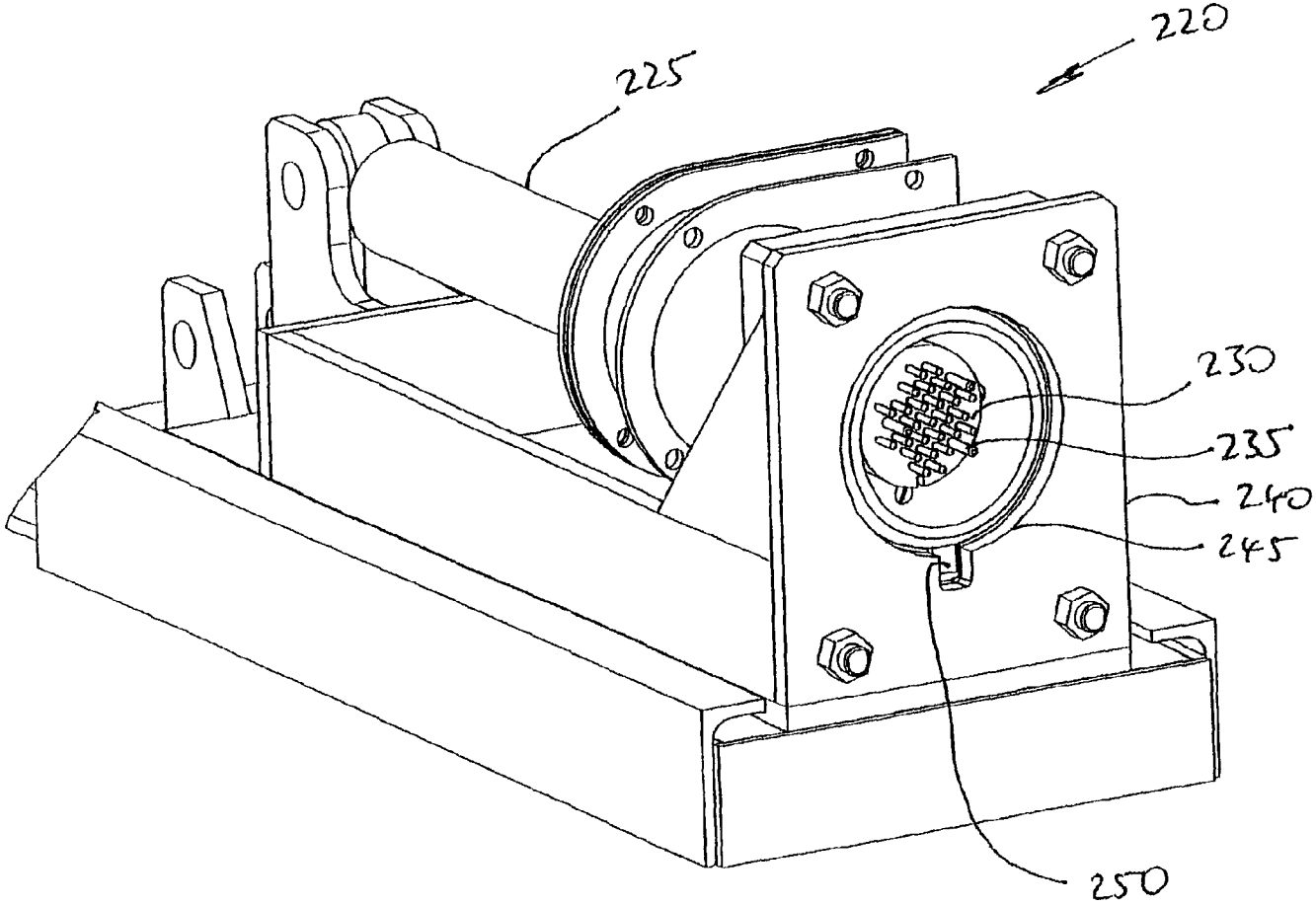
FIGS. 18 to 20 are various views of mutually engageable transmission connectors according to a still further embodiment of the present invention.
Figure 19:
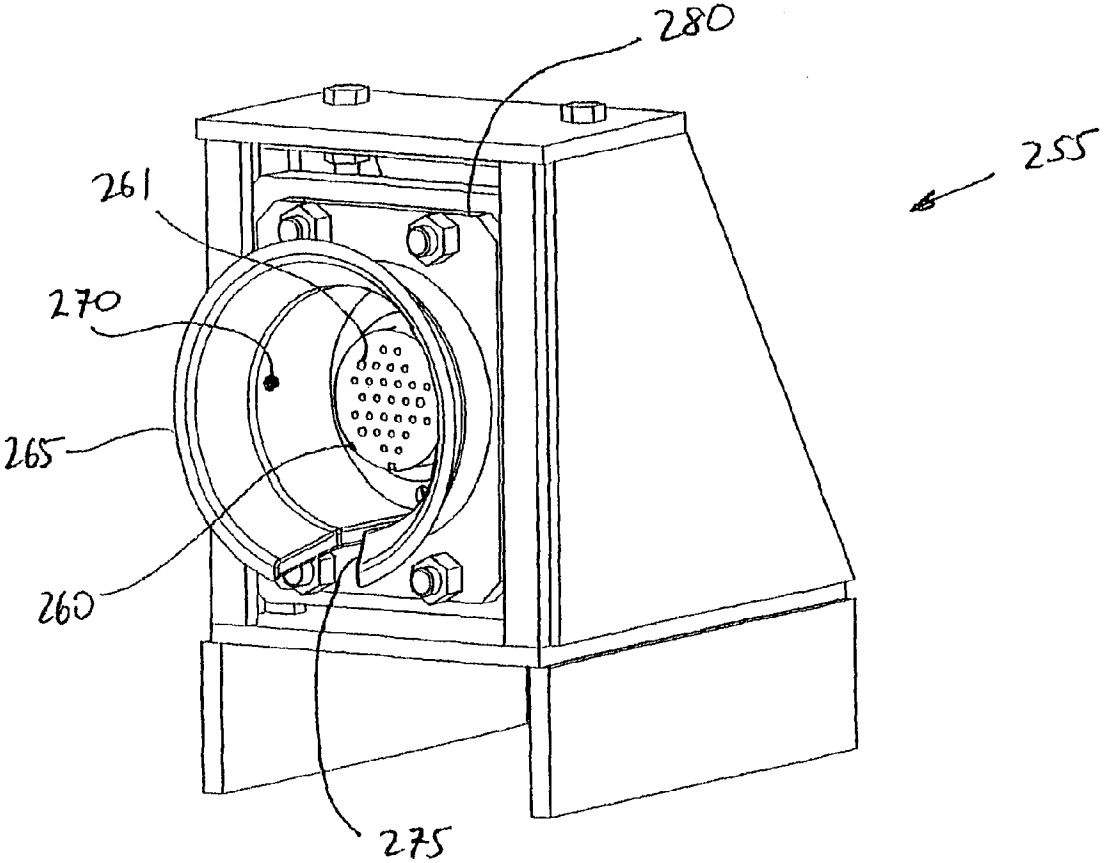
Figure 20:
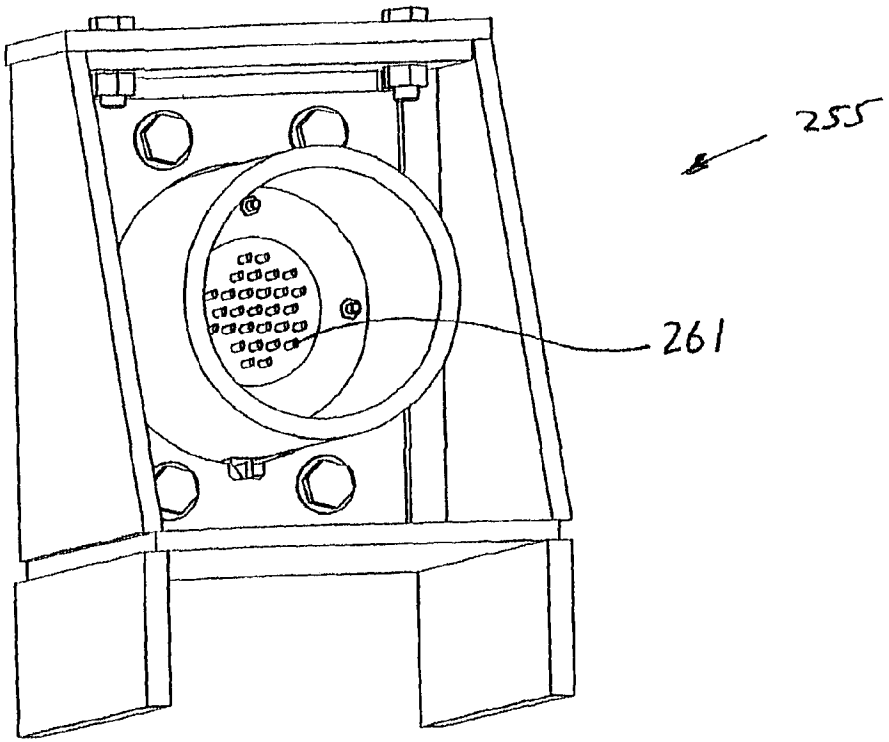

The present invention further provides for mutually engageable connectors 25, 30 mounted on the head frame 5 and spreader 10. One such mutually engageable electrical connector may include 3-phase 415V power supply, signal and communication plug and socket. Alternatively, the connectors may be inter-engageable hydraulic connection for a hydraulic power pack. FIGS. 18 to 20 show a further embodiment of a connector assembly according to one embodiment of the present invention.

In this case FIG. 18 shows a male connector 220 of the transmission connector. An actuator 225 is arranged to project a plug 230 from an aperture 245 so as to be engageable with the corresponding female connector. The plug 230 includes a key 250 to engage with the female connector on projecting from an orifice plate 240. The plug 230 includes individual pins 235 which may be arranged to transmit any or all of electrical power, telecommunication or data subject to the purpose of the transmission connector. The female connector 255 includes the socket 260 with the pins inserted into receiving recesses 261. Surrounding the socket 260 is a bell mouth spigot 265 which is sized to provide a tolerance for receiving the male plug 230. As the male plug enters the spigot 265, it reaches a cylindrical portion 270 which prevents lateral movement of the male plug 230 to further assist in alignment. The spigot 265 is mounted to a plate 280 which is also movable so as to permit a self alignment between the plugs 230, 260 and so allow for a relatively small misalignment such as 10 to 15 mm. It will be appreciated that the bell mouth 265 and mounting plate 280 may also be arranged to accommodate a larger tolerance or misalignment.

The key 250 of the male plug 230 is arranged to fit within a recess 275 within the spigot 265 and so prevent rotational misalignment of the plug so as to ensure the individual plugs 235 correspond to the receiving recesses 261. To this end the key recess 275 is flared outwards to receive the key 250 and gradually align the key into the recess 275.

FIG. 20 shows the opposite side of the female connector 255 showing the end portion of the plug recesses 261. In this case the plug recesses feed into individual plugs which can then be plugged into a flexible cable connecting the transmission connector.

Figure 2:
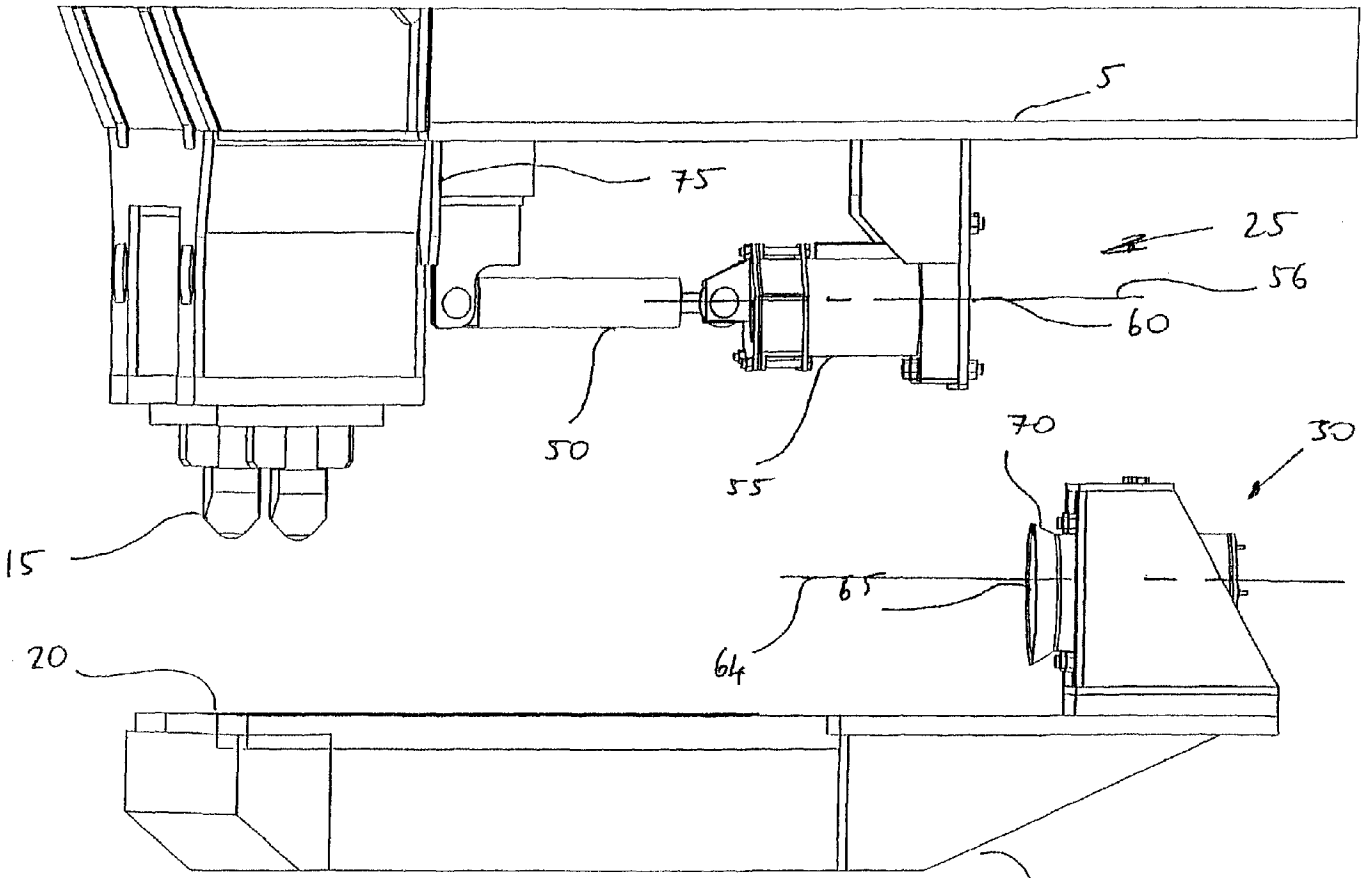

Returning to the application of the transmission connector to the head frame/spreader, FIG. 2 shows a male portion 60 of a connector 25 mounted to the head frame 5, which is arranged to engage the female connector, or socket 65, mounted to the spreader. It will be appreciated that the plug may instead be mounted to the spreader and the socket mounted to the head frame, and still fall within the present invention.

The head frame connector 25 comprises an actuator 50 arranged to linearly project and retract a plug 60 mounted within a housing 55. The actuator 50 is further arranged to retract and extend the plug 60 along an axis 56 representing the centerline of the plug 60. Corresponding to the head frame connector 25 is a spreader connector 30 having a socket 65 with a centerline 64 which is intended to align with the centerline 56 of the head frame connector 25. The spreader connector 30 further includes a bell mouth spigot or sleeve 70 which increases the diameter of the socket to receive the plug 60 so that misalignment of the male and female connectors is accommodated.

Figure 3:
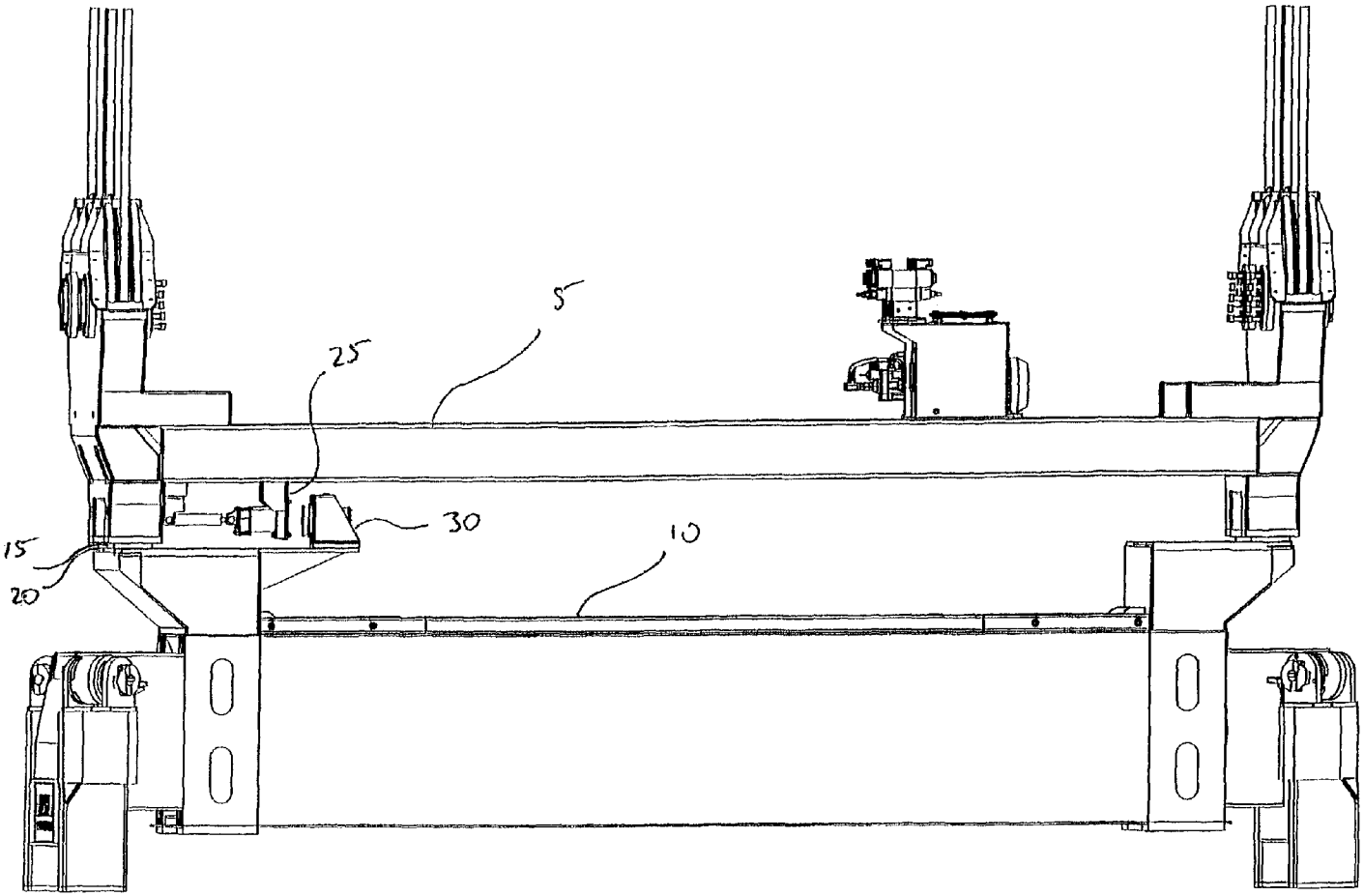
Figure 4:
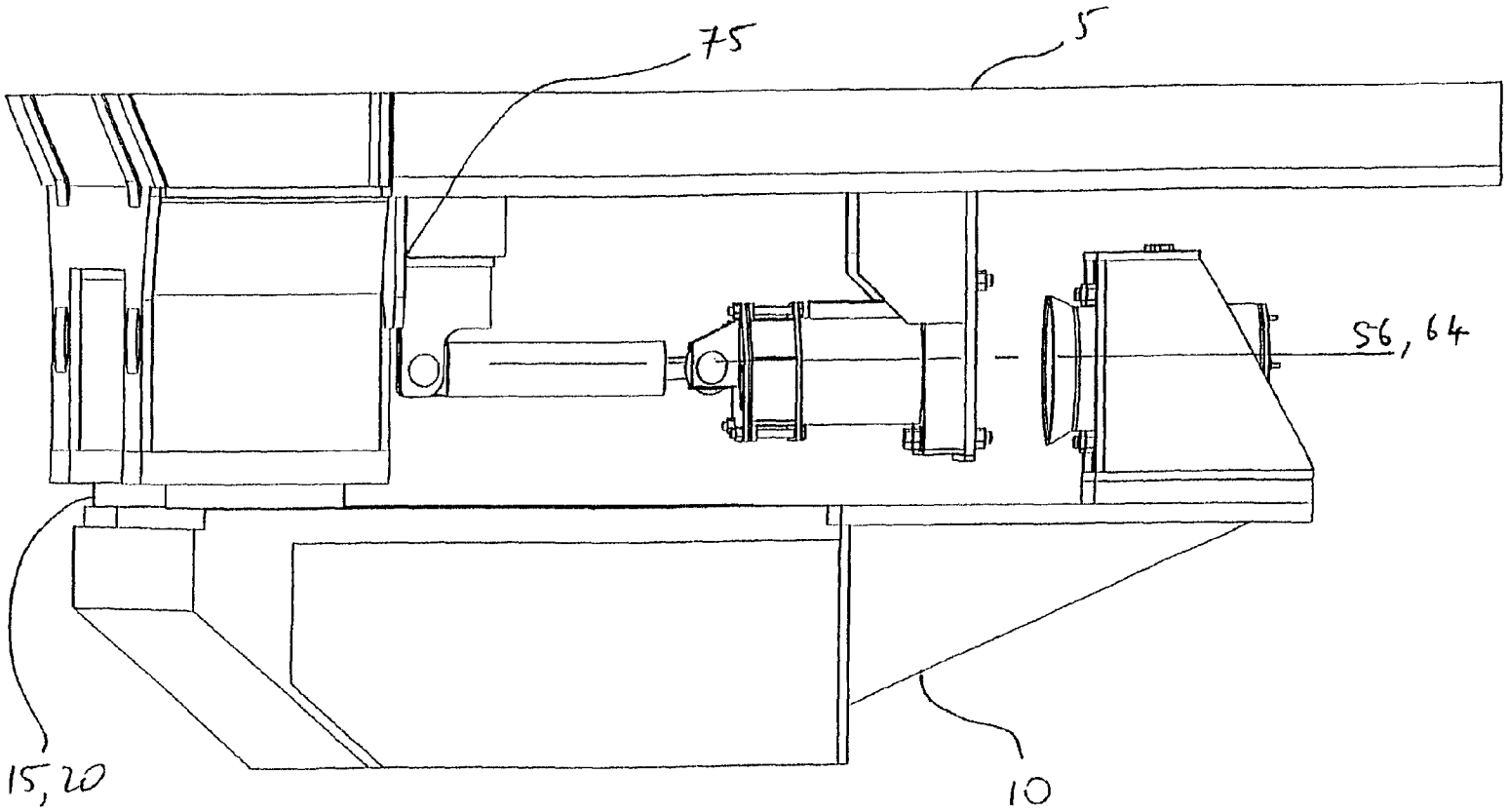

FIG. 3 shows the next step in the process with the twist lock having be actuated, and so locking the head frame 5 and spreader 10 with FIG. 4 showing an alignment of the centerlines 56, 64 of the connectors 25, 30. At this point a registration device (not shown) will be activated so as to communicate to the actuator that connection of the plug to the socket is permissible. At this point, the actuator may automatically operate so as to project the plug to engage the socket. Alternatively, the registration device may operate to allow manual operation of the connector. That is, the registration device may act as a "GO NO-GO" such that the actuator may be prevented from being operated until the registration device registers the engagement of the head frame and spreader. On such registration, manual operation may then be permissible, with the connector in standby mode to receive the manual instruction to commence engagement. The registration device may include a limit switch to register the coupling of the head frame and spreader. It may also include a control system for detecting the coupling and operate the actuator automatically.

Figure 5:
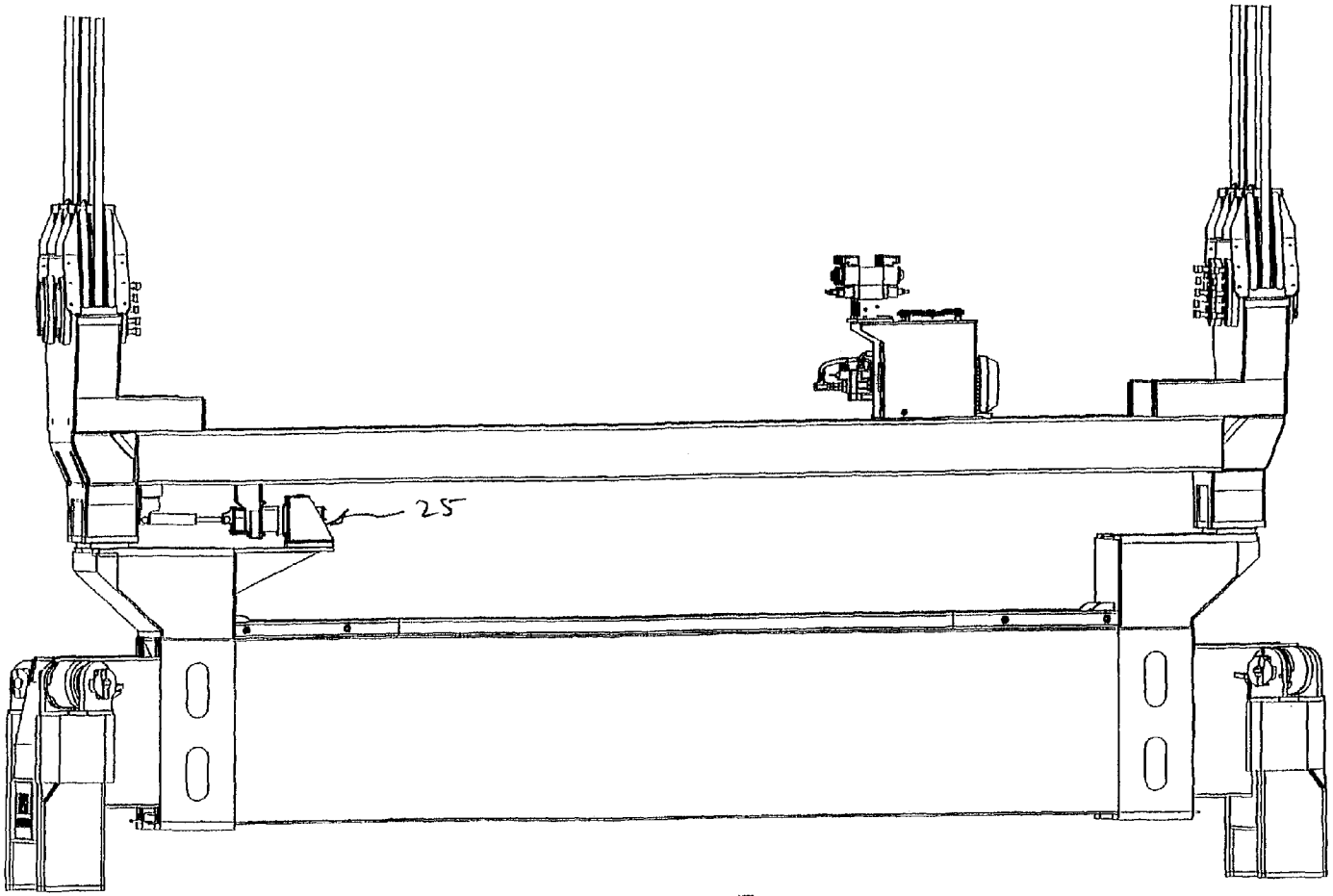
Figure 6:
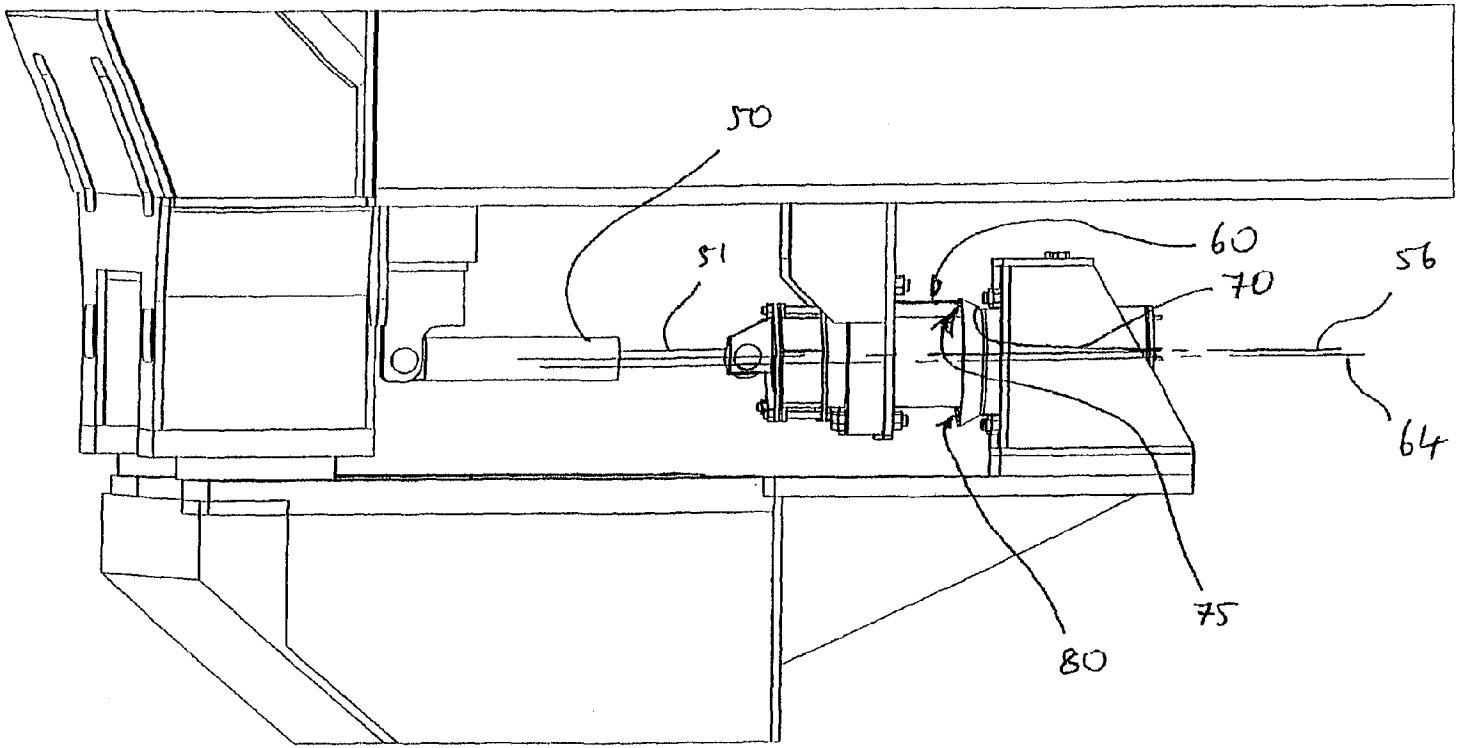

FIGS. 5 and 6 show the activation of the actuator whereby the plug 60 has extended as a result of the ram 51 extending from the actuator 50.

FIG. 6 demonstrates one possible arrangement whereby the centerlines 56, 64 are not perfectly aligned but are within the required tolerance. Here the plug may fit within the bell mouth 70 with the plug at an extreme upper portion 75 leaving a gap 80 for the bell mouth. Thus the mounting plate to which the bell mouth is mounted will move laterally to accommodated this misalignment of the centerline 56, 64 and still maintain an electrical, telecommunication or data connection between the head frame and spreader.

Figure 7:
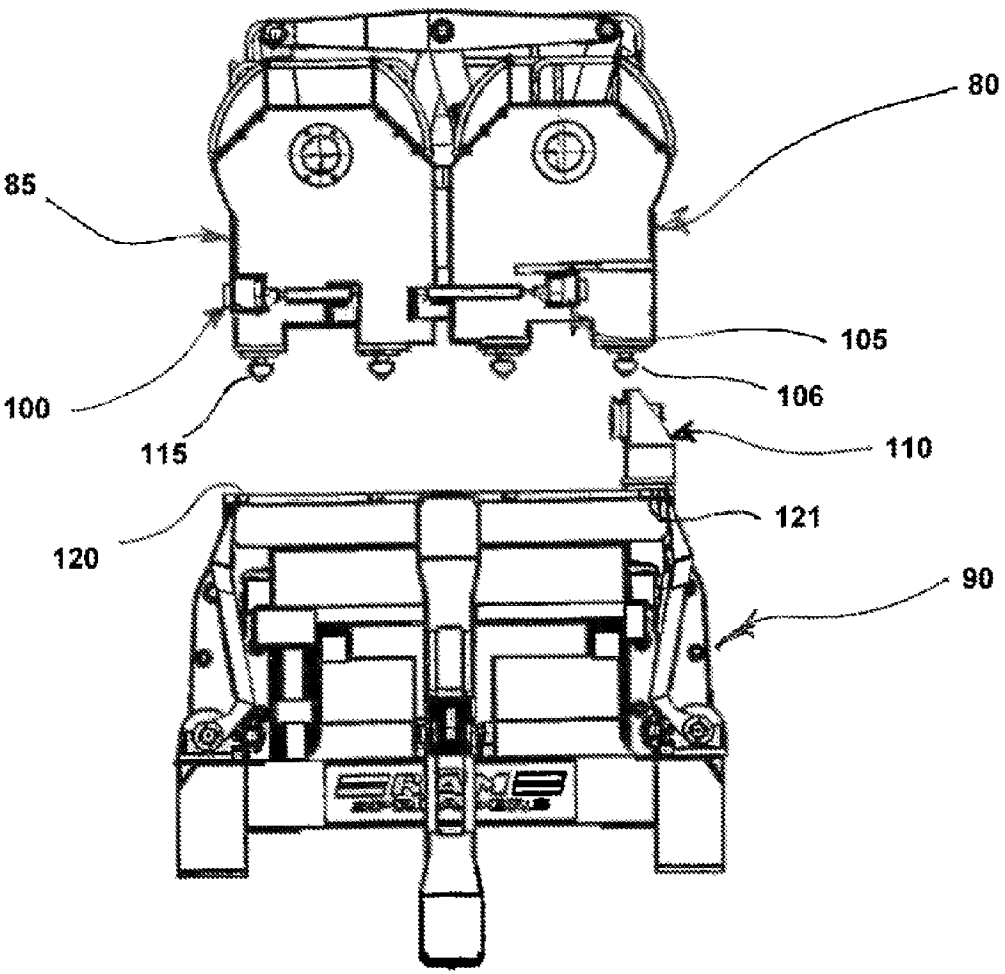
FIGS. 7 to 12 are sequential elevation views of a twin spreader application according to a further embodiment of the present invention.

FIGS. 7 to 12 show a further embodiment of a multiple spreader system. FIG. 7 in particular shows an expandable head frame arrangement having two head frames 80, 85 in a refracted position so as to engage with a single spreader 90. As before, the first head frame 80 includes twist locks 106 to engage with apertures 121, with the second head frame 85 having twist lock 115 to engage with a second set of apertures 120. As before the spreader includes a bottom connector portion 110 which is engageable with a top connector portion 105 mounted to the first head frame 80. Where this embodiment differs from the embodiment of FIG. 1 is having on the second head frame 85 a second top connector portion 100. In this arrangement, the two top connected portions 100, 105 are capable of engaging connected portions associated with two spreaders. In the embodiment shown in FIG. 7 however, only the connected portion 105 associated with the first head frame 80 is required for the single spreader application.

Figure 8:
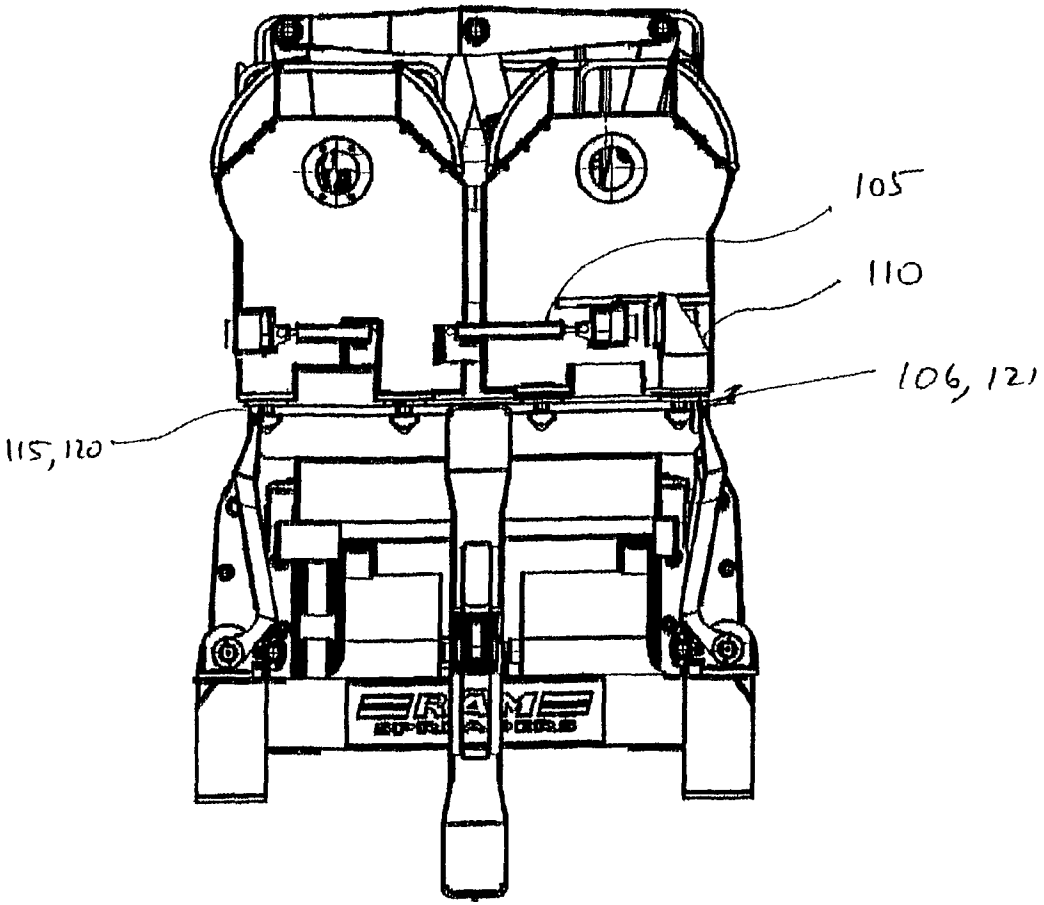

FIG. 8 shows the next step in the engagement whereby the twist locks 106, 115 have coupled to the corresponding apertures 120, 121 so as to couple the head frame to the spreader. As will be seen the two top connected portions 100, 105 are now aligned ready for engagement.

Figure 9:
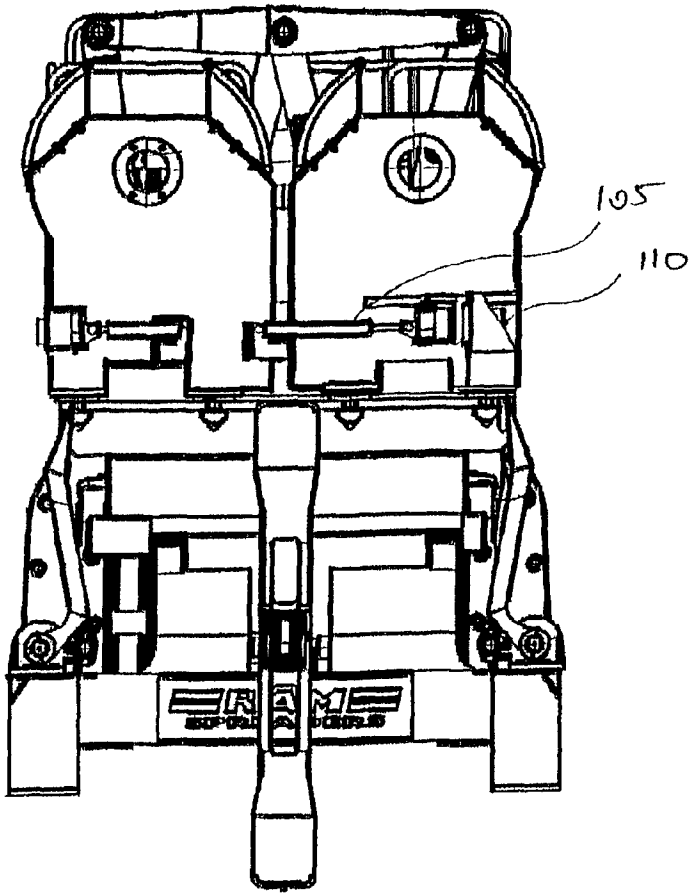
Figure 10:
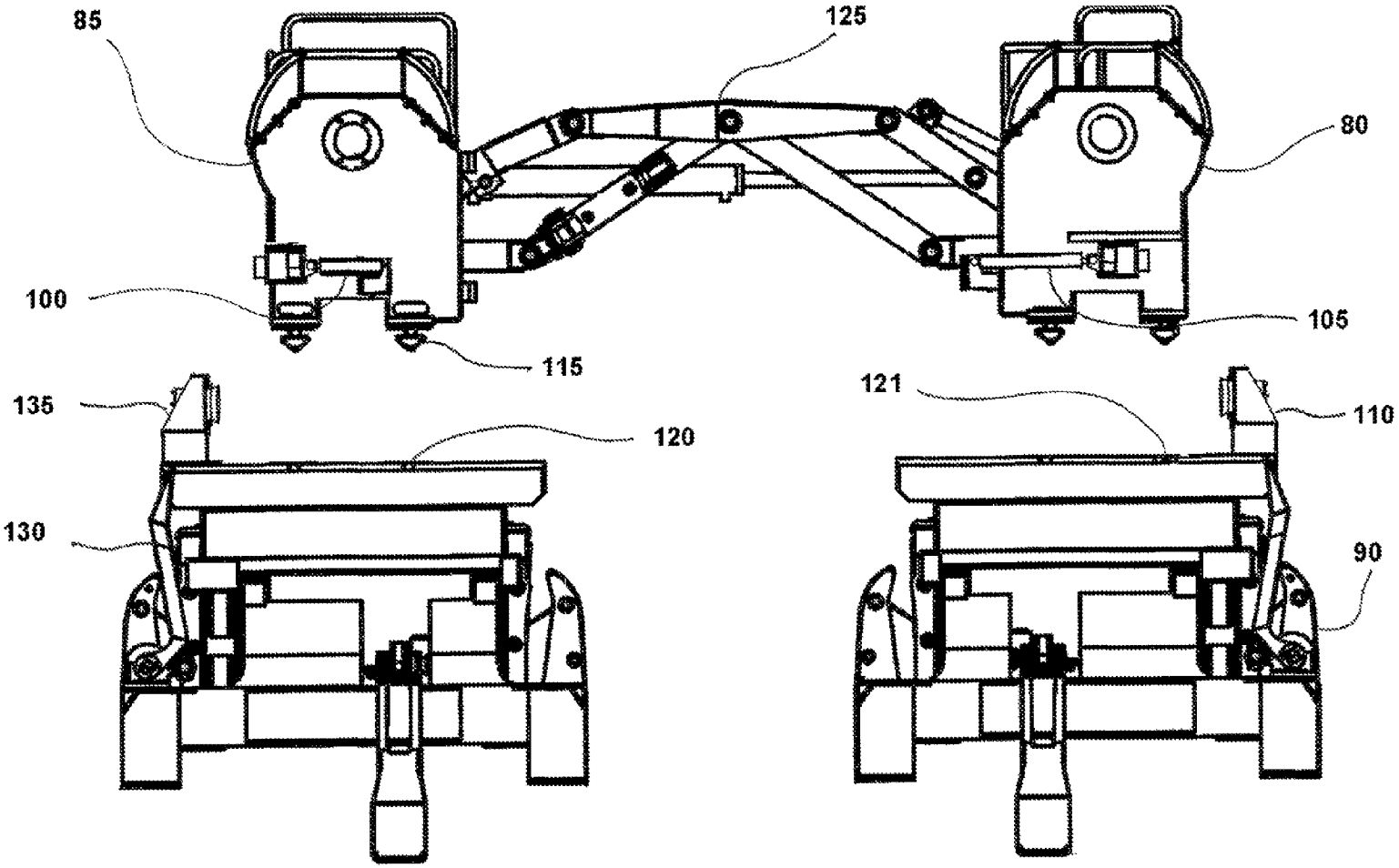

FIG. 9 shows a further step whereby the first top connected portion 105 of the head frame has now projected a plug into a socket of the bottom connected portion 110 of the spreader so as to provide a connection for the power supply, data or telecommunication signal between the head frame and the spreader. In an alternative arrangement, the head frames 80, 85 are expandable by an expanding assembly 125 so as to mount distinct spreaders 90, 130. It will be noted that each of the spreaders 90, 130 have bottom connected portions 110, 135 for engagement with the connected portion or plugs mounted to the respective head frames 80, 85.

Figure 11:
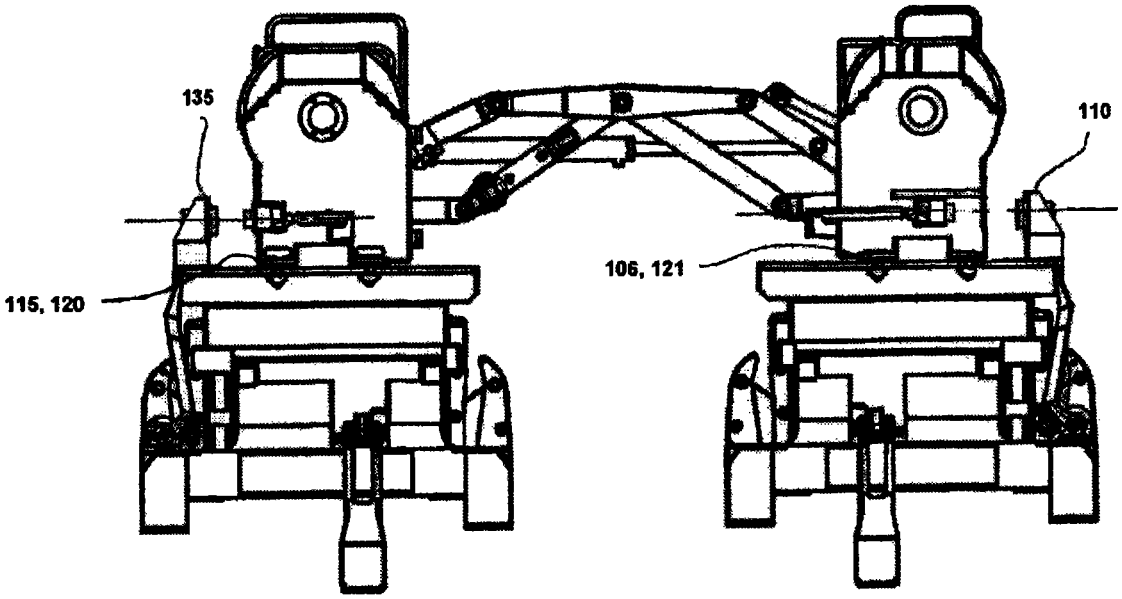
Figure 12:
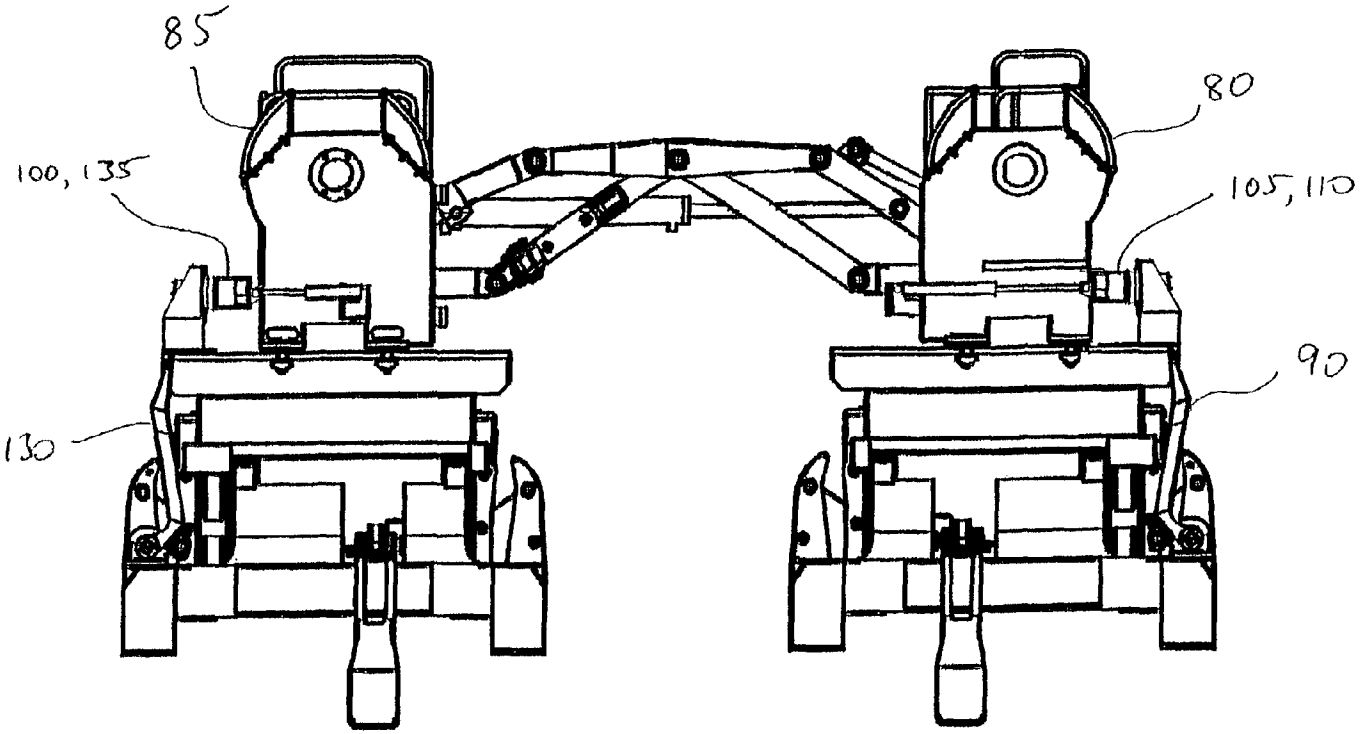
Figure 13:
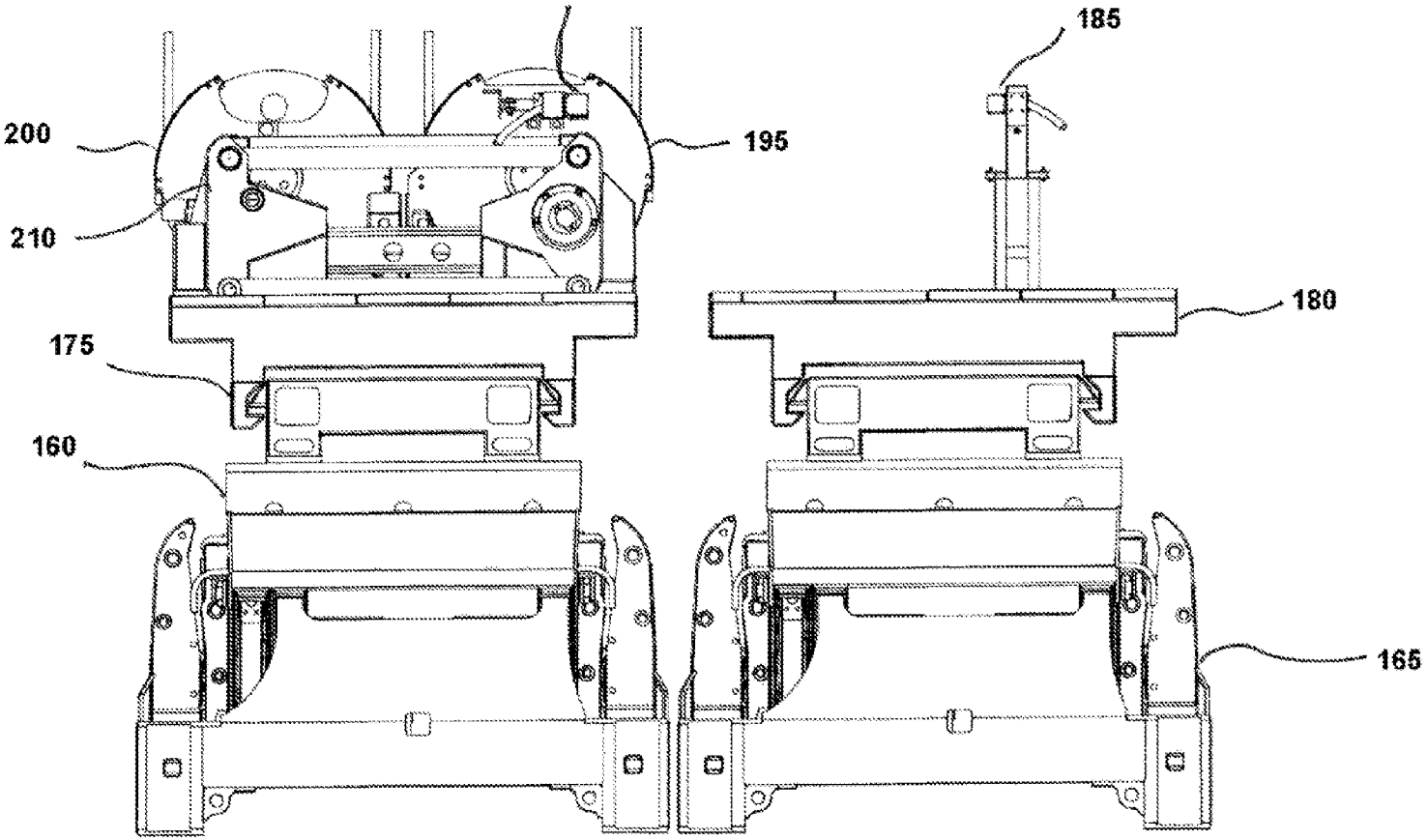
FIGS. 13 to 17 are sequential elevation views of a twin spreader application according to a further embodiment of the present invention.

FIGS. 11 and 12 show the subsequent steps following coupling of the head frames to the spreaders whereby the connected portions are now aligned due to the locking of the head frame to spreader with FIG. 12 in particular showing the extension of the actuator so as to engage the plug with the top connected portions 100, 105 (e.g., a socket) for the first head frame 80 engaged with the first spreader 90. Correspondingly, the second head frame 85 engaged with the second spreader 130 involves connection of a second plug with a second socket. Thus the embodiments shown in FIG. 9 and FIG. 12 show the uses of the invention where the head block or head frame can accommodate coupling with a single spreader and further with two spreaders.

Figure 14:
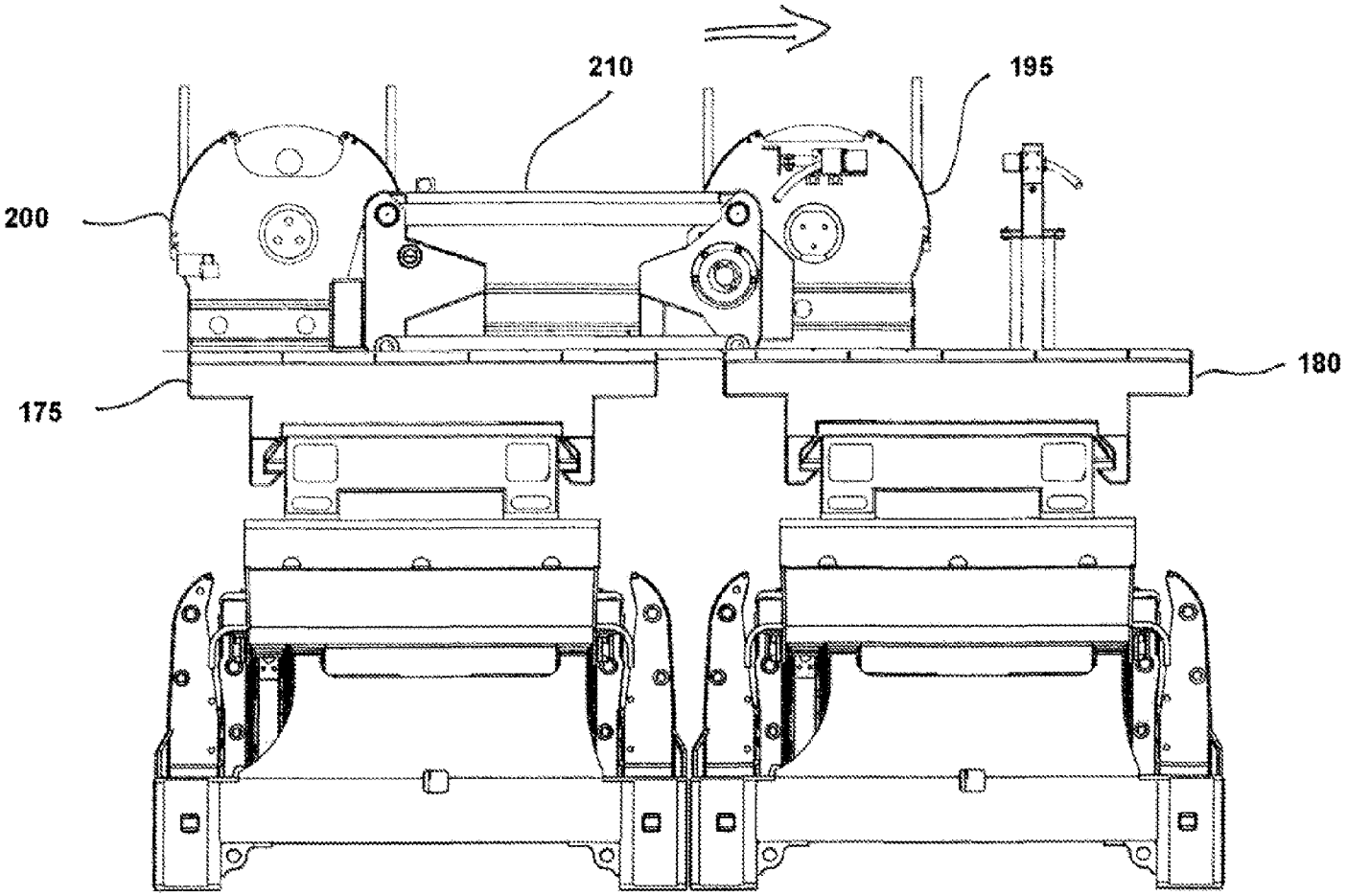
Figure 15:
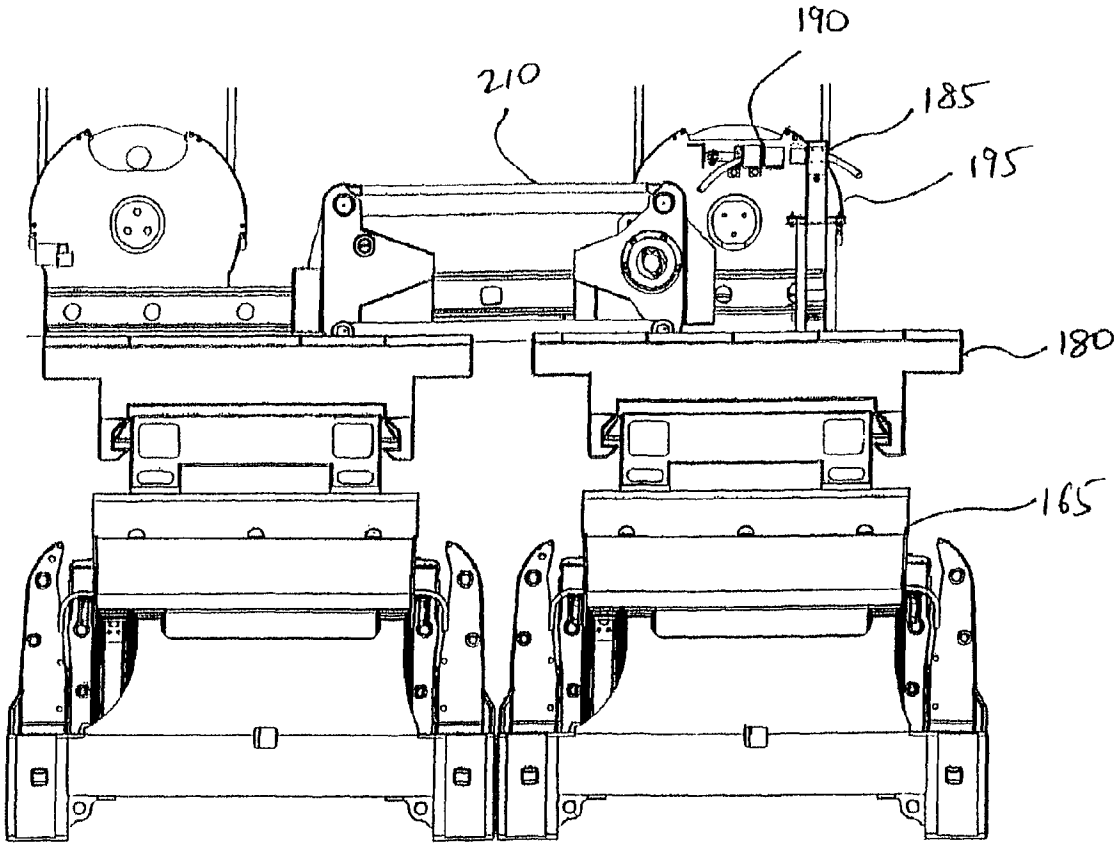
Figure 16:
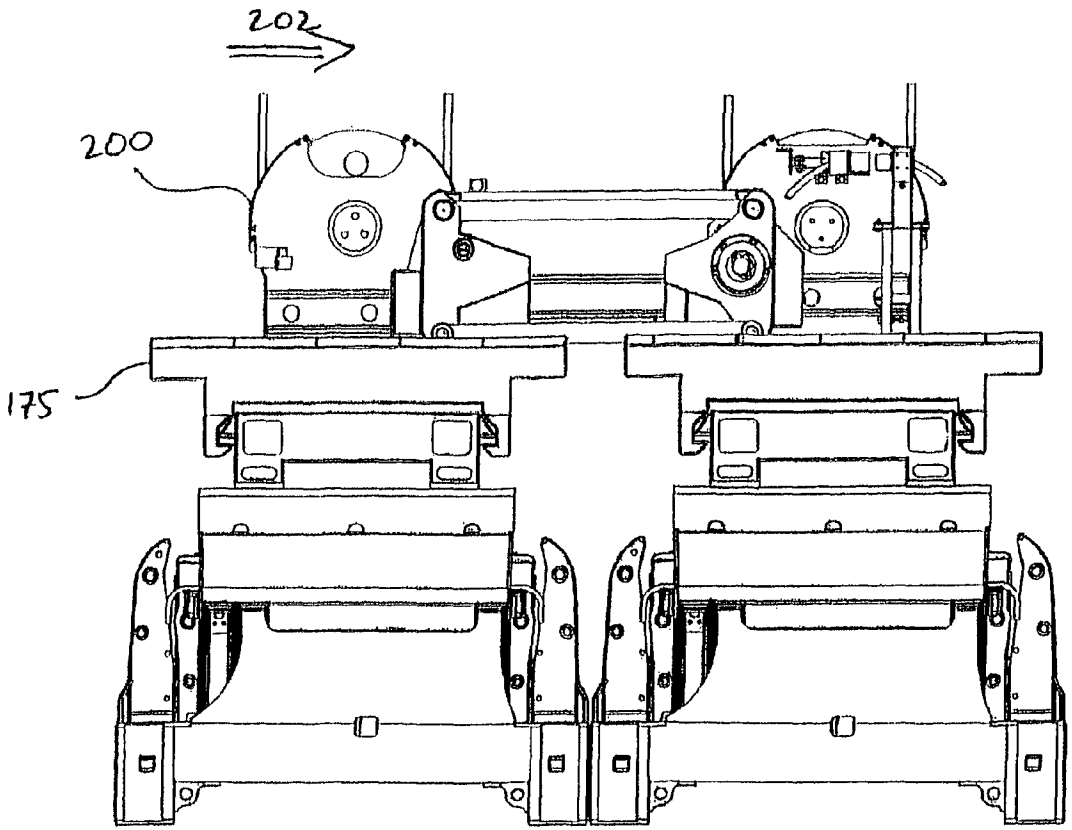
Figure 17:
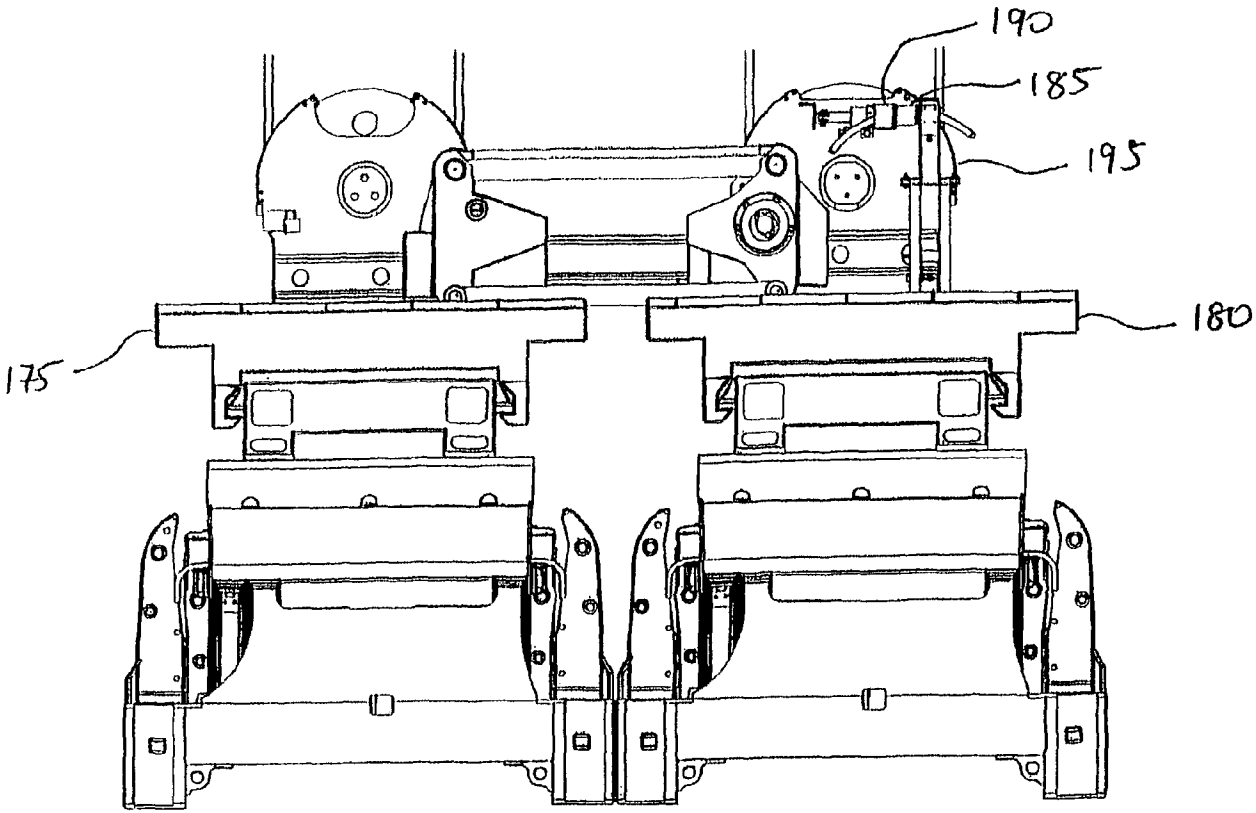

FIGS. 13 to 17 show a further embodiment of the present invention whereby a master/slave arrangement is adopted for the spreaders. In this case, a master spreader 160 to which is mounted a master head frame 175 is used for a single spreader arrangement. In this arrangement, two sets of sheaves 195, 200 are mounted to the master head frame 175. Power is provided to the master head frame/spreader and so the transmission connector according to the present invention is required when coupling to a slave head frame/spreader. FIG. 14 shows the transfer arrangement from the single spreader to the double spreader arrangement. A sliding mechanism 210 moves the second sheave 195 from the master head frame 175 to the slave head frame 180. FIG. 15 shows the completion of the transfer of the sheave 195 to the slave head frame 180 so as to position the male connector 190 proximate to the female connector 185. FIG. 16 shows the movement 202 of the first sheave 200 so as to be centralized on the master head frame 175 with FIG. 17 showing the connection of the transmission connector 185, 190 so as to provide power, telecommunication or data connection to the slave head frame 180.

Thus, whilst the invention involves the transmission connection of a spreader to a head frame, in the case of FIGS. 13 to 17, the spreader in this case is a slave spreader 165 with the connection to the head frame being the engagement of the second sheave 195 with the slave head frame 180 so as to complete the connection of sheave/head frame/spreader. In this case the registration device is arranged to register the coupling of the second sheave 195 to the slave head frame 180 and so whilst the slave head frame 180 is already mounted to the slave spreader 165, the complete connection cannot occur until the slave head frame 180 has fully coupled the second sheave 195 and so with the positioning of the second sheave 195 to the slave head frame 180, the full connection of the head frame to the spreader is therefore, achieved.

Figure 21A:
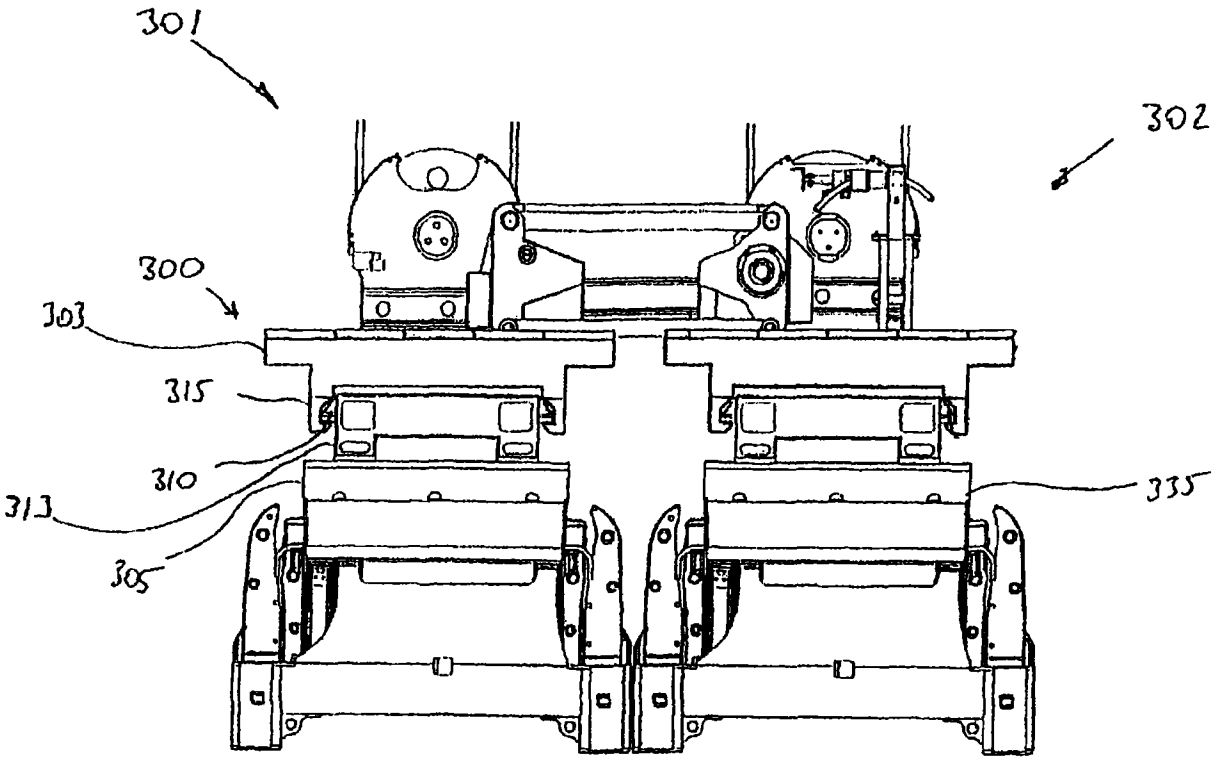
FIGS. 21A to 21C are various views of a head frame to spreader coupling according to one embodiment of the present invention.
Figure 21B:
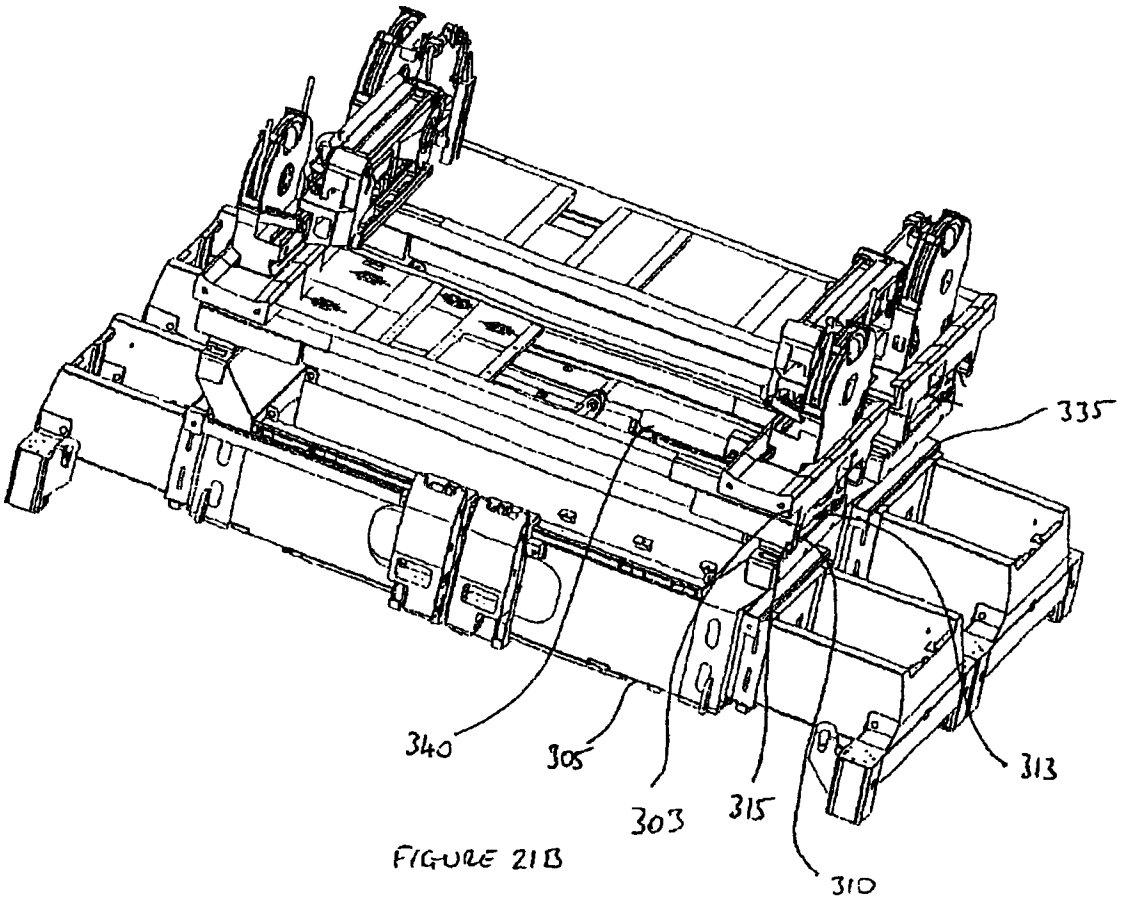
Figure 21C:
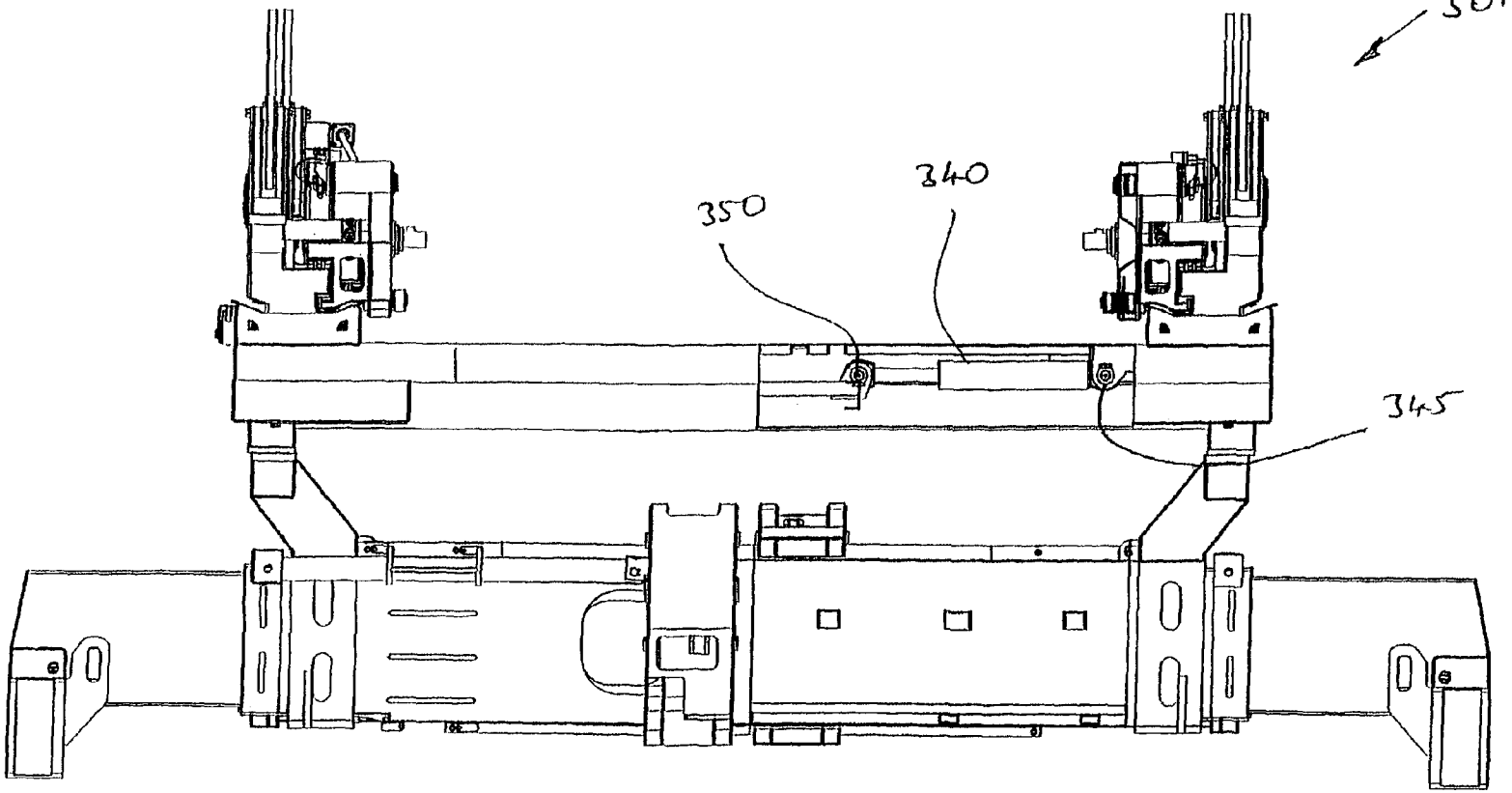

FIGS. 21A to 21C show an embodiment of one aspect of the present invention. Here a spreader assembly 301 comprises a head frame 300 mounted to a spreader 305. In this embodiment the head frame 300 comprises a main frame 303 and a subframe 313. The main frame 303 and subframe 313 are in longitudinal sliding engagement through cooperating members 310, 315.

The head frame 300 coupling arrangement has the advantage of precisely positioning the relative positions of the head frame and spreader whilst still providing relative movement between the head frame and spreader should it be required.

Figure 22A:
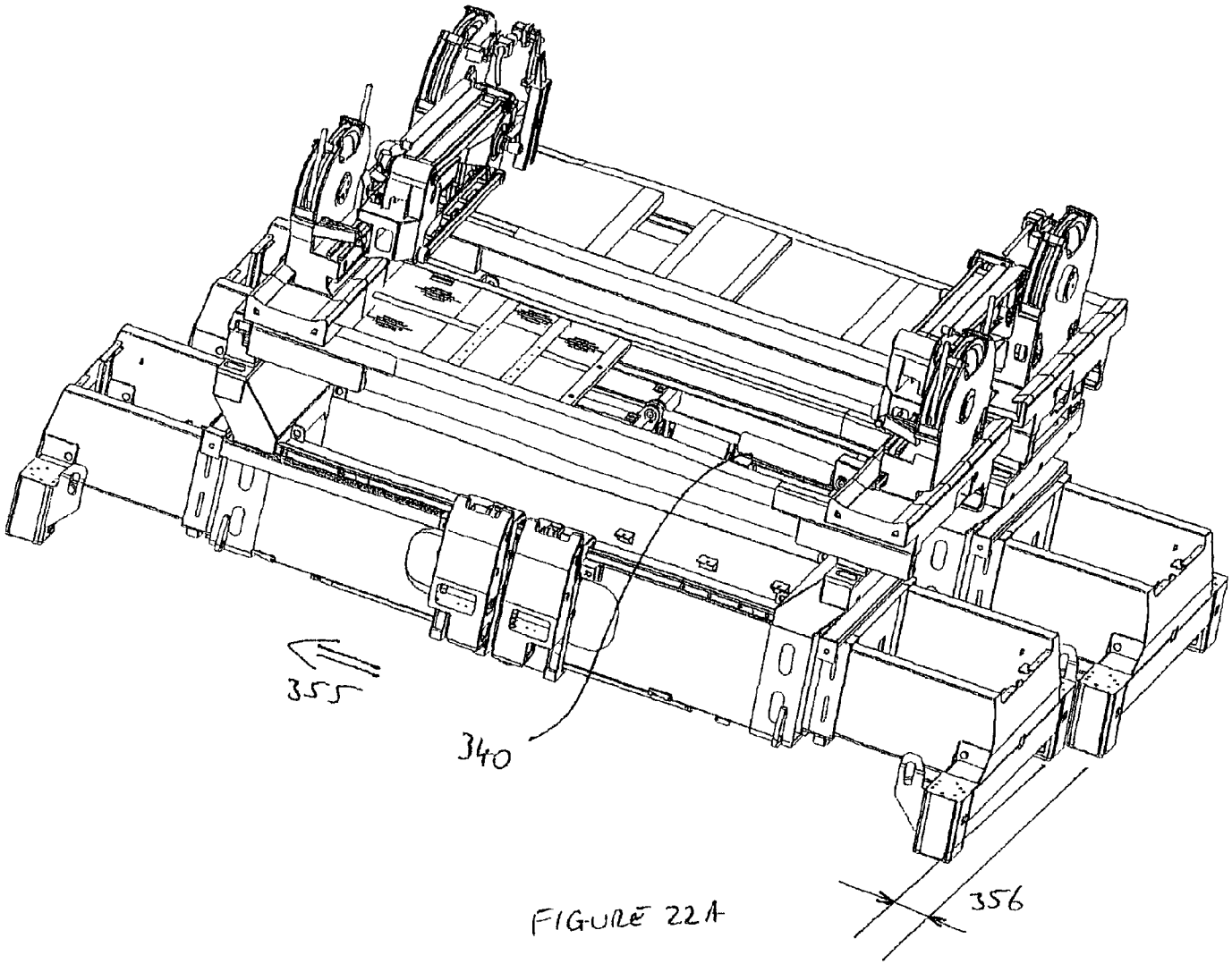
FIGS. 22A to 22B are various views of the head frame to spreader coupling of FIG. 21A.

By way of example of the sliding engagement, FIGS. 22A/B and 23A/B show sequential views of the twin spreader assemblies 301, 302 of FIGS. 21A to C.

Figure 22B:
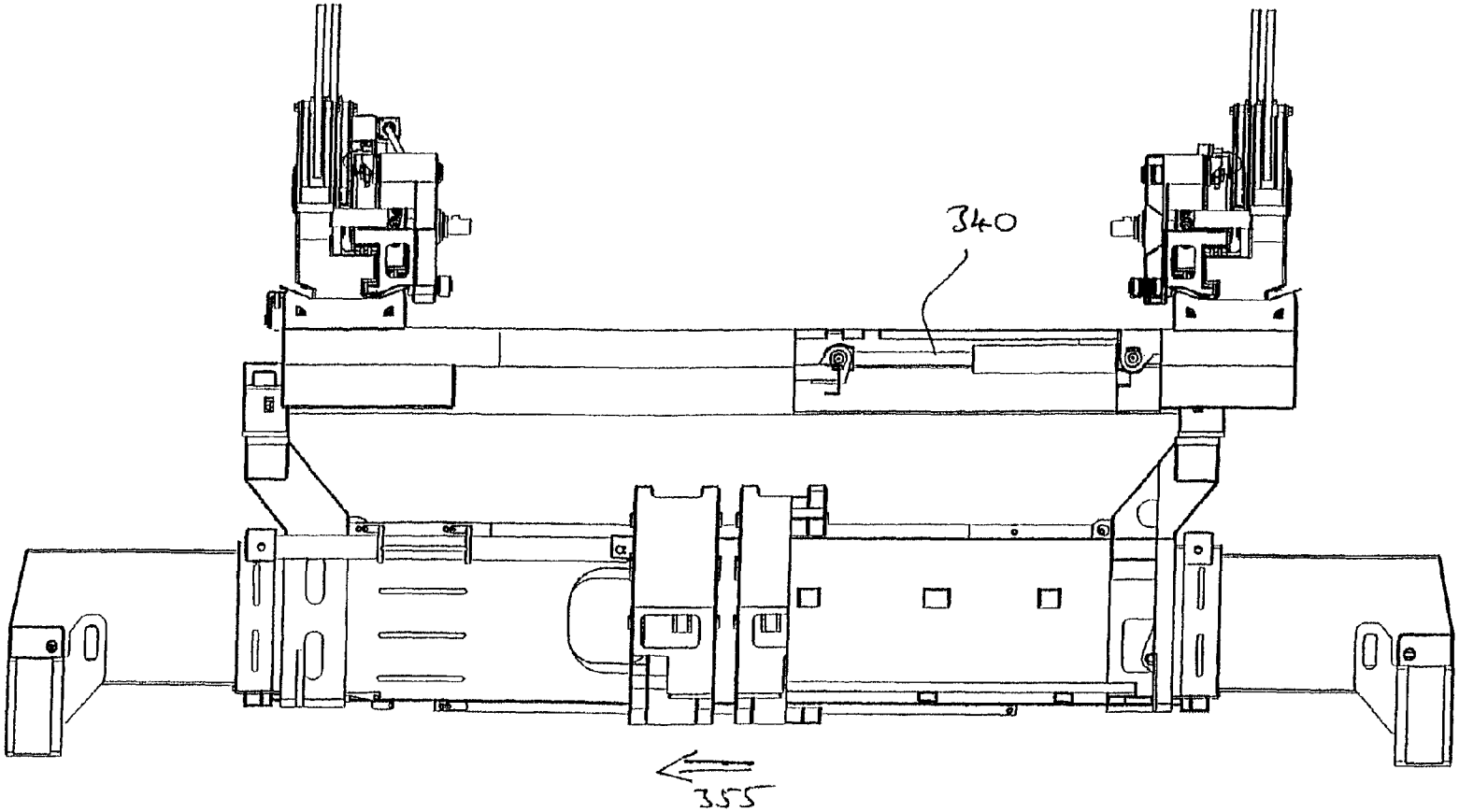

To achieve the relative offset between the adjacent spreaders 305, 335 and actuator 340 is position having one end 350 connected to the sub frame 313 of the master spreader assembly 301. The other end of 345 of the actuator 340 is connected to the master head block main frame 303. The actuator 340 is arranged to move the head block sub frame 313 and consequently the attached spreader 305 relative to head block main frame 303 using the sliding coupling 310, 315 between the two elements. The relative position of the head block and spreader is shown in FIGS. 21B and 21C in an initial position whereby the adjacent spreaders 305, 335 are level. FIGS. 22A and 22B show the effect on activation of the actuator 340 whereby the master spreader 305 moves 355 relative to the head block 300 creating an offset 356 between the adjacent spreaders 305, 335.

Figure 23A:
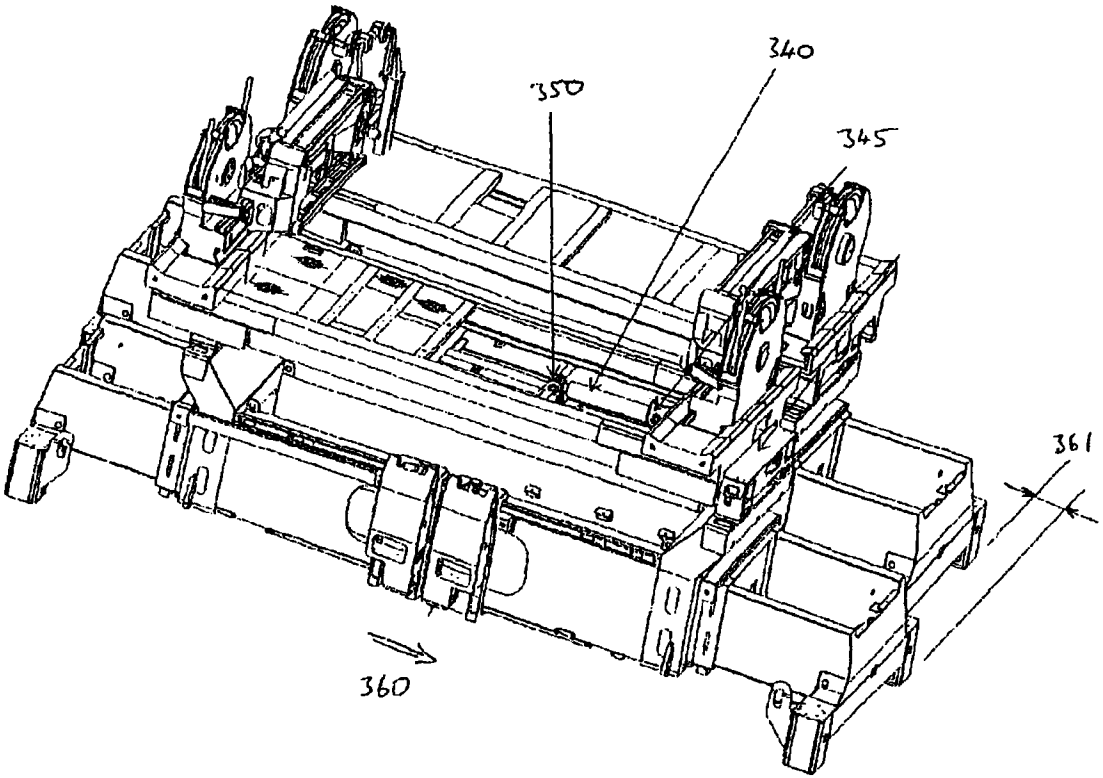
FIGS. 23A to 23B are various views of the head frame to spreader coupling of FIG. 21A.
Figure 23B:
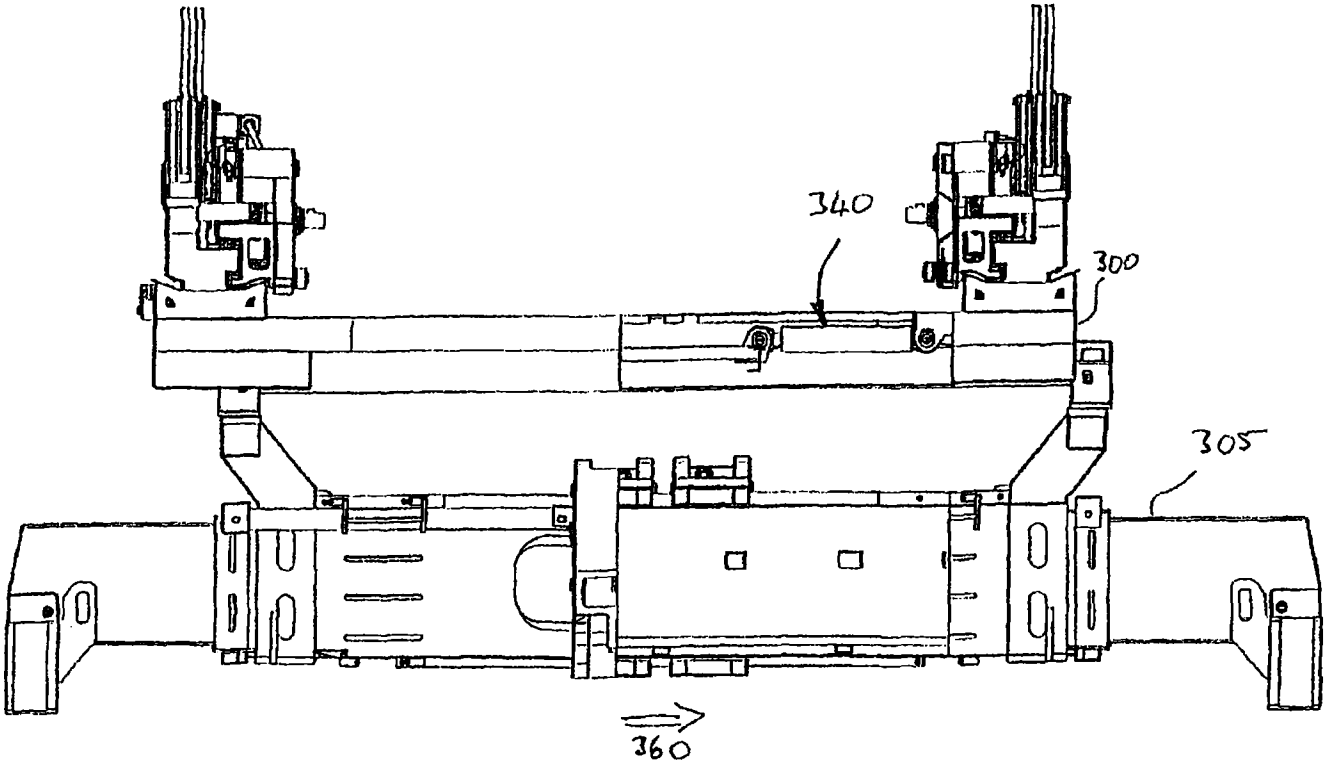

FIGS. 23A and 23B show the opposite movement whereby the actuator 340 is refracted and so causing a relative movement 360 between the head block and spreader and so creating an offset 361 between the adjacent spreaders.

The invention claimed is:

1. A system for mounting a head frame to a spreader comprising:

a sheave assembly connecting the head frame to a crane so as to permit the lowering of said head frame;

mutually cooperating engagement devices for coupling the head frame and the spreader;

an actuator arranged to connect mutually engageable transmission connectors on the head frame and spreader; and a registration device for registering the coupling of the head frame and the spreader; wherein the registration device is arranged to prevent engagement of the transmission connector until said head frame and spreader are coupled.

2. The system according to claim 1, wherein the registration device prevents engagement through selectively disabling the actuator.

3. The system according to claim 2, wherein on registering the coupling of the head frame and spreader, the registration device operates the actuator to engage the transmission connector.

4. The system according to claim 1, wherein on registering the coupling of the head frame and spreader, the registration device operates the actuator to engage the transmission connector.

5. The system according to claim 1, wherein the head frame may be a twin head frame in a retracted position, such that the engagement devices are positioned to engage a single spreader.

6. The system according to claim 5, wherein the twin head frame includes a master head frame and a slave head frame, with the single spreader being a master spreader, said slave head frame coupled to a slave spreader, such that the registration device is arranged to prevent engagement of the transmission connector until said registration device registers coupling of the slave head frame to the slave spreader and coupling of a sheave to the slave head frame.

7. The system according to claim 1, wherein the head frame is a first head frame of a twin head frame assembly, said twin head frame assembly in an expanded position, such that the first head frame is arranged to couple with the spreader, and further including a second spreader, the second head frame arranged to couple with the second spreader.

8. The system according to claim 1, wherein the transmission connector includes corresponding plug and socket for transmission of electrical power, data transfer and/or telecommunications signals.

9. The system according to claim 8, wherein the plug is mounted to the head frame and the socket is mounted to the spreader.

10. The system according to claim 1, wherein the registration device includes a limit switch in communication with the actuator, such that on activation of the limit switch the actuator is arranged to receive a signal and extend the connector.

11. The system according to claim 1, wherein the registration device includes a control system for receiving an input on coupling of the head frame and spreader and activating the actuator on receiving said input.

12. A method for mounting a head frame to a spreader comprising the steps of:

lowering the head frame into contact with the spreader;

operating engagement devices and so coupling the head frame to the spreader;

registering the coupling of the head frame and the spreader, and when coupled, then;

activating an actuator to connect mutually engageable power supply connectors on the head frame and spreader so as to provide a power communication between said head frame and spreader.

13. The method according to claim 12 wherein the head frame includes a twin head frame in a retracted position, said coupling step including coupling both head frames to the spreader.

14. The method according to claim 12 wherein the head frame includes a twin head frame in an expanded position, further including a second coupling step of coupling a second head frame to a second spreader.

* * * * *